US005285663A

United States Patent [19]

Taniguchi

[11] Patent Number: 5,285,663

[45] Date of Patent: * Feb. 15, 1994

[54] ROLLING AND DISCHARGING DEVICE OF KNITTED FABRIC ON CIRCULAR KNITTING MACHINE AND ITS CONTROLLING METHOD

[75] Inventor: Kozo Taniguchi, Kobe, Japan

[73] Assignee: Precision Fukuhara Works, Ltd., Japan

[ * ] Notice: The portion of the term of this patent subsequent to Jul. 6, 2010 has been disclaimed.

[21] Appl. No.: 946,387

[22] Filed: Sep. 17, 1992

[51] Int. Cl.[5] ..... D04B 15/88; B21C 47/24

[52] U.S. Cl. ..... 66/153; 66/151; 242/58.6; 242/79

[58] Field of Search ..... 66/149 R, 151, 152, 66/153; 112/121.11; 242/58.6, 65, 79; 139/457

[56] References Cited

U.S. PATENT DOCUMENTS

| | | | |
|---|---|---|---|
| 3,839,885 | 10/1974 | Bourgeois | 66/151 |
| 4,721,266 | 1/1988 | Haapanen et al. | 242/58.6 X |
| 4,888,963 | 12/1989 | Scherzinger et al. | 66/151 |
| 4,901,656 | 2/1990 | Yoshida | 112/121.11 |
| 5,042,272 | 8/1991 | Furr | 66/151 |
| 5,136,859 | 8/1992 | Nitta | 66/151 |
| 5,157,948 | 10/1992 | Rikiishi et al. | 66/151 |
| 5,186,408 | 2/1993 | Planeta | 242/65 |

FOREIGN PATENT DOCUMENTS

| | | | |
|---|---|---|---|
| 0485717 | 5/1992 | European Pat. Off. . | |
| 0157976 | 12/1982 | Fed. Rep. of Germany | 66/153 |
| 3704048 | 3/1988 | Fed. Rep. of Germany . | |
| 1313007 | 4/1973 | United Kingdom | 66/151 |

*Primary Examiner*—Clifford D. Crowder
*Assistant Examiner*—John J. Calvert
*Attorney, Agent, or Firm*—Bell, Seltzer, Park & Gibson

[57] ABSTRACT

Knitted fabric produced by a circular knitting machine passes downwardly to a fabric winding unit that rotates synchronously with the knitting unit and that includes fabric delivery rolls and a fabric winding shaft that are driven by rotation of the unit. The winding unit also includes a fabric guide that guides the fabric onto the shaft, a fabric cutter that cuts the fabric after a preselected quantity of it has been wound upon the roll, a fabric receiving table, and a thruster that removes the wound fabric from the center shaft and discharges the fabric onto the fabric receiving table and thereafter from the machine. A central processing unit and associated sensor and switch elements monitor and/or control operation of the knitting machine and winding unit.

20 Claims, 17 Drawing Sheets

ROLLING AND DISCHARGING DEVICE OF KNITTED FABRIC ON CIRCULAR KNITTING MACHINE AND ITS CONTROLLING METHOD

CROSS-REFERENCE TO RELATED APPLICATIONS

Some of the subject matter disclosed in the present application is also disclosed in commonly assigned U.S. patent application Ser. No. 07/912,915.

FIELD OF THE INVENTION

This invention relates to circular knitting machines, and more specifically relates to a circular knitting machine having improved means for winding the knitted fabric and discharging it from the knitting machine.

BACKGROUND OF THE INVENTION

The fabric winding unit of a circular knitting machine usually is either suspended from and rotatable with the large diameter ring gear of the machine, or is mounted for rotation upon a central part of the machine. In the latter case, one or more drive members connected to the machine's large diameter ring gear impart synchronous rotation to the winding unit.

A suspension type winding unit is usually employed for an interlock stitch knitting machine having a double bed. For example, the invention disclosed in Japanese published Patent No. Hei 2-191751 discloses a suspension type fabric winding unit, and also discloses an automatic "thrusting"](i.e., pushing) device that engages and pushes the rolls of knitted fabric wound by the winding unit. The device of such patent is provided with a rotatable fabric winding roll or shaft having one end that is releasably connected to a support arm of a device for rotating the shaft. The other end of the shaft acts as a universal joint and is supported by a second support arm on the opposite side of the winding unit. The fabric rolled on the shaft is transferred to a discharge position by transfer means. A reciprocatingly movable thrusting device located adjacent a fabric discharge position effects discharge of the rolled fabric from the machine.

A problem arising with a suspension type winding unit is that it places a heavy load upon the drive components of the means for transferring the roll of knitted fabric to a discharge position. This problem has been eliminated by the invention disclosed in Japanese published Patent No. Hei 2-319144, which was published subsequent to filing of the commonly owned Japanese application upon which the present application asserts priority rights. In such invention a displaceable transfer means that displaces the roll of fabric to a discharge position temporarily restrains the shaft upon which the fabric is wound and permits the roll of fabric to fall freely to a discharge position so as to reduce the load on the transfer means. However, due to the relatively large vertical distance through which the fabric falls, its final position is somewhat uncertain.

The fabric knitted by the ordinary knitting machine, and particularly pile fabric, usually is wound into a soft roll. This presents another problem since when the roll of fabric is removed from the shaft of the winding unit by the fabric thrusting device, the side of the fabric roll may be deformed by the device to such an extent that the thrusting stroke is insufficient. This results in non-ejection of the rolled fabric from the machine.

SUMMARY OF THE INVENTION

The present invention is free from the foregoing problems and enhances the productivity of the fabric knitting and winding process by providing a unit which automatically winds and discharges the knitting fabric, and which also provides a method of controlling the fabric winding unit so as to allow an ordinary circular knitting machine to operate at increased speeds and with increased productivity.

In a preferred embodiment the fabric winding unit of the invention is mounted for rotation beneath the needle cylinder by a support member adjacent the bottom of the knitting machine, and rotates synchronously with the cylinder. Rotation of the unit about a vertical axis drives fabric delivery rolls and a fabric winding shaft. The unit includes fabric guiding means for guiding the cut end of the knitted fabric to the winding shaft. The shaft is positioned in close proximity to the center of laterally spaced frame members of the unit, and one end of the shaft is so connected to the adjacent frame member as to act as a universal joint. The shaft has an opposite end that is detachably connected to the other frame member. The shaft is radially dimensionally adjustable, and has retractable and extendible comb means. The fabric winding unit also has a fabric cutter; means to stop the winding unit at a fabric discharge position; a shaft latching/unlatching device for at desired times releasing the fabric winding shaft from the support frames; a rolled fabric receiving table rotating with the winding unit and adapted to receive the rolled fabric; and a thrusting or pushing device to discharge the rolled fabric from the shaft and knitting machine.

The rolled fabric receiving table preferably has a recess at a location approximately perpendicular to the direction along which the fabric is discharged. A shaft latching/unlatching device associated with means for moving the rolled fabric to the discharge position is preferably provided with an L-shaped supporting part and a latch member disposed beyond the bottom of said shaped supporting part so as to prevent displacement of the shaft during its return movement to the supporting frames.

The fabric thrusting device preferably both withdraws the rolled fabric from the fabric winding shaft and discharges it from the knitting machine. Preferably, a space is provided under a C-shaped opening in one of the shaft supporting frames so as to allow access of the thrusting device to the fabric.

A stationary electricity supply device at the center of rotation of the winding unit provides electricity to motor, switches and the like that rotate with the unit.

The center shaft of the winding unit is capable of deviating from the horizontal, and preferably is provided with a detecting switch for detecting whether the shaft is mounted on the supporting frames. Detecting switches are preferably also provided for detecting whether the shaft locking/unlocking device is locked.

The control means of the invention includes a detecting switch for stopping the winding unit at a preselected position after driving the knitting machine at low speed in response to control signals, and another detecting switch confirming that the winding unit has stopped in such position. A detecting switch for detecting winding of the fabric is preferably fixed to the rolled fabric receiving table.

A method of controlling the automatic fabric winding and discharging unit of the invention preferably includes the following steps:

(a) guiding the fabric after knitting of it to the center shaft of the winding unit by fabric guiding means;

(b) attaching the fabric to the winding shaft by use of the retractable and extendible comb means carried by the shaft;

(c) rolling the fabric on the shaft;

(d) detecting whether a selected quantity of the knitted fabric has been rolled upon the shaft;

(e) stopping the shaft at a selected discharge position;

(f) cutting the knitted fabric with cutting means;

(g) opening and closing a gate before and after the roll of fabric is discharged, respectively, (h) unlatching and latching the shaft before and after the rolled fabric is discharged, respectively;

(i) moving the fabric winding shaft and rolled fabric from the winding unit by moving the free end of the shaft downwardly relative to the shaft's opposite end when discharging the rolled fabric; and returning the shaft to its initial position after the rolled fabric is discharged;

(j) letting the rolled fabric fall from the winding shaft to the fabric receiving table;

(k) moving the rolled fabric from the fabric receiving table by fabric thrusting means; and (l) discharging the rolled fabric from the knitting machine.

When the revolution of the knitting machine reaches a value one less than a first preset value, the machine is driven at medium speed. The machine is driven at a low speed when the revolution reaches a second preset value, prior to being stopped at a preselected position.

The fabric thrusting device preferably pushes against the rolled fabric, withdraws, and then again pushes so as to insure discharge of the fabric from the machine without fail.

Sensors preferably monitor the steps in the conveyance of the knitted fabric, and detect any malfunctions. Operation of the fabric cutting device is preferably confirmed by monitoring the amperes in the cutter motor and cutter shifting motor.

After the knitted fabric winding and discharging device displace the rolled fabric and winding unit center shaft from the supporting frame the fabric falls onto the receiving table. A movable arm slows its fall so as to reduce the possibility of rebound or "bounce" of the roll of fabric.

The rolled fabric preferably is received in a recess of the receiving table and is then discharged from the knitting machine via said recess by the fabric thrusting device.

DESCRIPTION OF THE DRAWINGS

Other features of the invention will be apparent from the following description of a preferred embodiment thereof, which should be read in conjunction with the accompanying drawings, in which.

DESCRIPTION OF THE PREFERRED EMBODIMENTS

Figure 1:
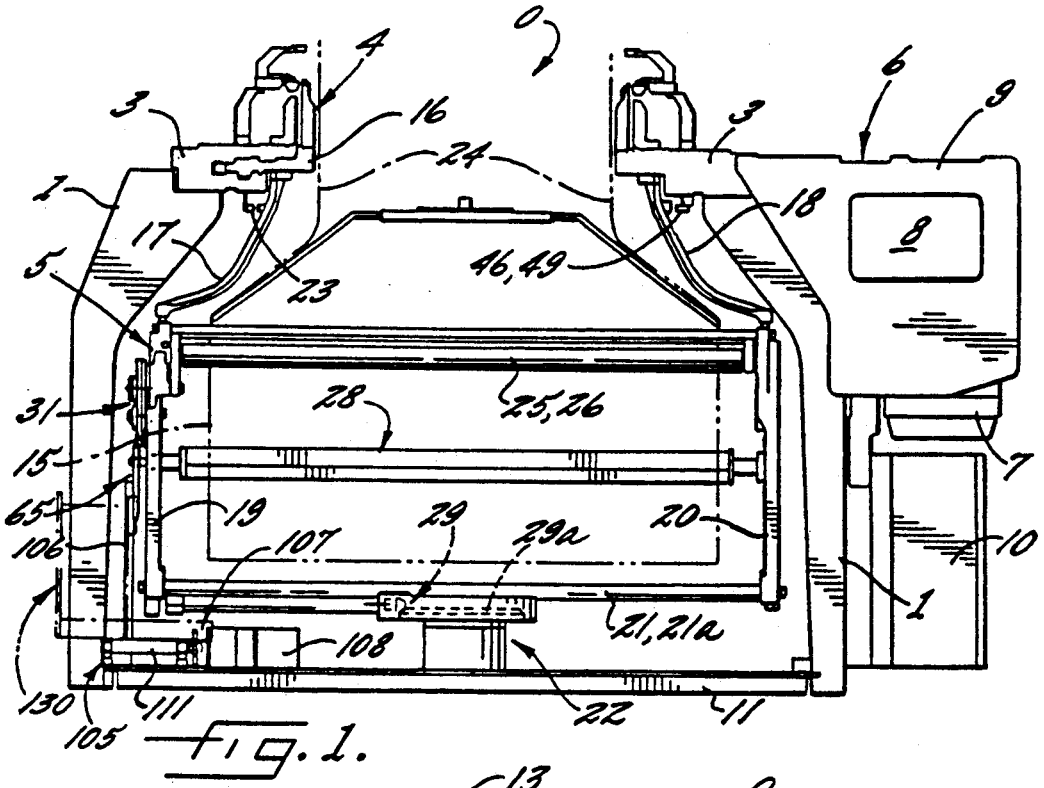
FIG. 1 is a front elevational view of a circular knitting machine having a fabric winding unit in accordance with the invention.

FIG. 1 of the drawings shows a circular knitting machine O that includes a knitting unit 4 disposed above a circular bed 3 supported by a plurality of upstanding legs 1, 2 of the frame of the knitting machine. Unit 4 is connected to and rotatable with a large diameter ring gear 16 supported by bed 3 and driven by a driving unit 6 having a motor 7 and a cover 9 that includes a digital panel 8. An AC invertor motor control panel 10 (hereinafter "ACI" panel) underlies driving unit 6.

A support member 11 interconnecting lower end portions of legs 1, 2 stabilizes such legs and supports a rotatable fabric winding unit 5 for rotation about the vertical axis of a support member 22 mounted upon and centrally of member 11. Guard nets 12, 13 and 14 (FIG. 2) are disposed between legs 1, 2, and net 14 has a subsequently described movable gate 152 (FIG. 27) through which rolls of fabric 24 are discharged from machine O.

The fabric winding unit 5 located within the lower part of machine O includes opposite side frame members 19, 20 between which extend a plurality of rotatable fabric delivery rolls 25–27, a rotatable fabric winding shaft 28, and bolts 21, 21*a*, that connect frame members 19, 20 to each other and that are connected to member 22 and are rotatable upon its vertical central axis. Drive bars 17, 18 connected to and extending downwardly from gear 16 to side frames 19, 20 rotate unit 5 in synchronized relationship to rotation of gear 16.

Figure 2:
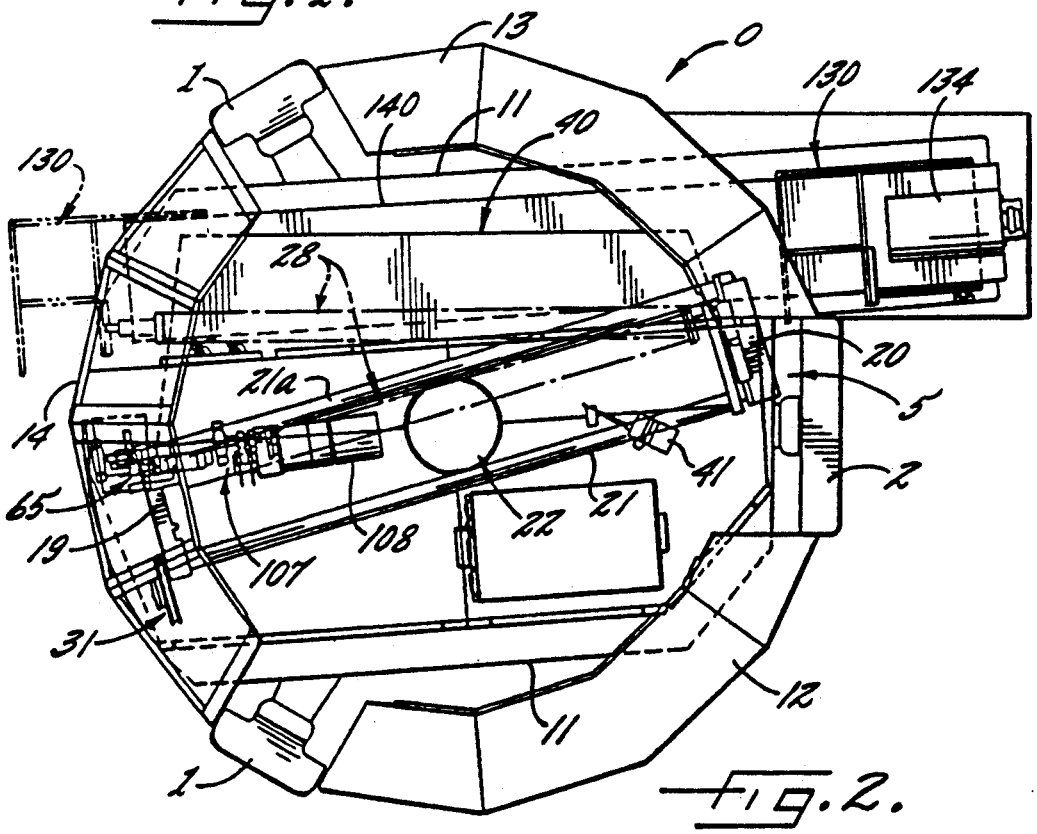
FIG. 2 is a top plan view of the machine and unit of FIG. 1.
Figure 3:
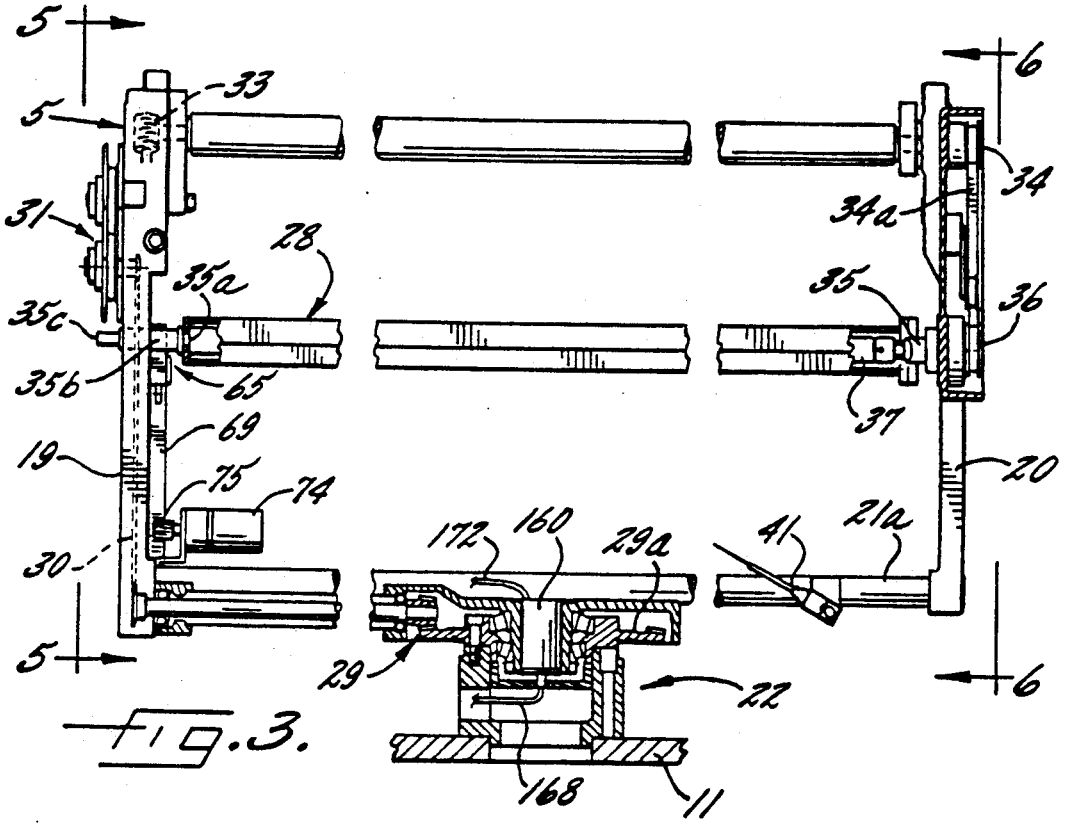
FIG. 3 is a foreshortened elevational view of the winding unit, some components being shown in vertical section.
Figure 5:
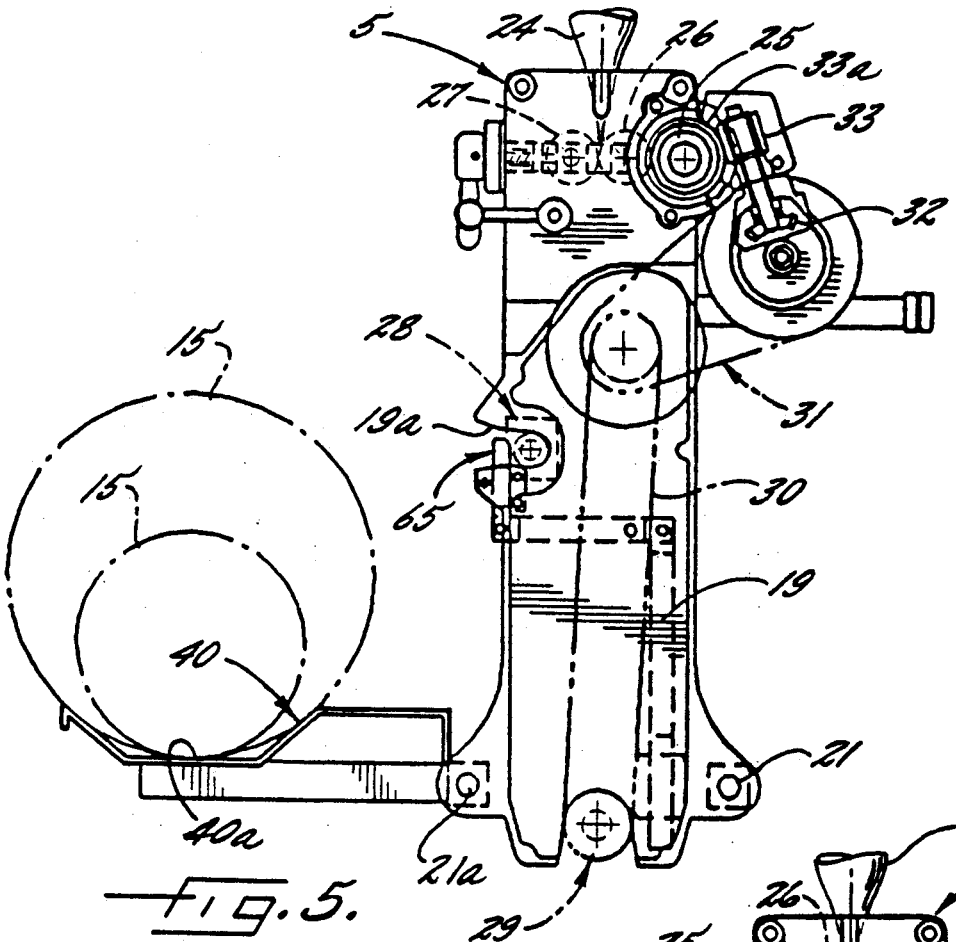
FIG. 5 is a left side elevational view of the winding unit.
Figure 6:
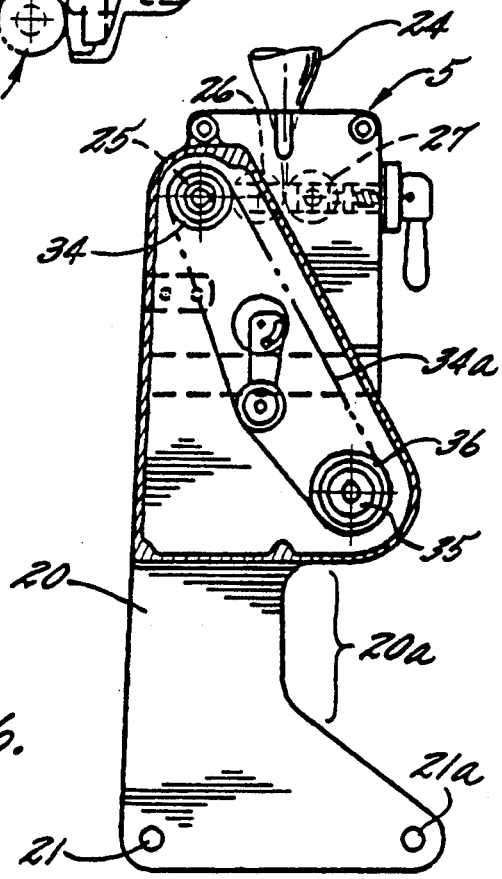
FIG. 6 is a right side elevational view of the winding unit.
Figure 29:
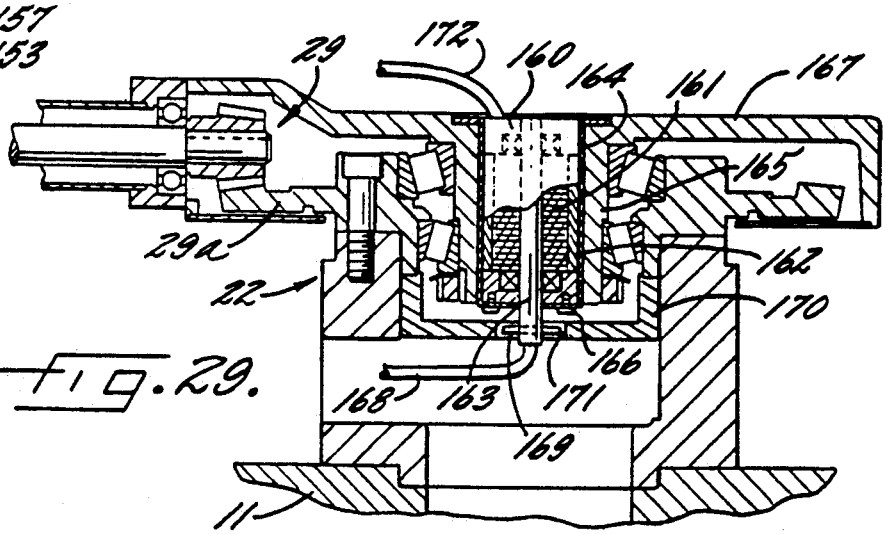
FIG. 29 is an enlarged view, primarily in vertical section but with some components shown in elevation, of the member supporting the winding unit for rotation and of a power supply unit and other components associated therewith.

Referring now particularly to FIGS. 3 and 29, power transmission means associated with unit 5 and member 22 (FIGS. 1 and 2) drives delivery rolls 25–27 and shaft 28 in response to rotation of unit 5. The transmission means includes a first bevel gear 29 (FIGS. 23 and 29) that meshes with and is driven by a stationary bevel gear 29*a* when unit 5 is rotated; and a chain mechanism 30 that is carried by frame member 19 and is entrained at one end about a sprocket upon the shaft that supports gear 29. The other end of mechanism 30 drives a variable speed pulley mechanism 31. Mechanism 31 includes a bevel gear 32 (FIG. 5) that drives a worm gear 33 that drives the delivery rolls of unit 5. A belt mechanism 34*a* upon frame member 20 is driven by a spur gear 34 upon one of the delivery rolls, and imparts rotation via pulleys 34, 36 to center shaft 28 of winding unit 5. One end (the right end, as viewed in FIG. 3) of shaft 28 acts as a universal joint that is supported by frame 20 even when the shaft slopes relative to the horizontal. The opposite (left, as viewed in FIG. 3) end of shaft 28 is supported by., and at times movable downwardly from, a C-shaped opening 19*a* (FIG. 5) of frame 19 with which a subsequently described latching/unlatching device 65 is associated.

Proximity switches 23 (FIG. 1) for detecting the knitting speed and revolution of knitting machine 0 are secured by holder 48 to the bottom of bed 3 and to driving bar 17.

The fabric 24 knitted by knitting unit 4 is delivered downwardly from such unit by at least two of the delivery rolls 25–27. The fabric is then wound while in a flat condition upon rotatable fabric winding shaft 28.

A preferred construction of shaft 28 of unit 5 is shown in FIGS. 11–16 of the drawings. The shaft construction is also disclosed in commonly assigned copending U.S. patent application Ser. No. 07/912,915, and the disclosure in such application of the shaft construction is incorporated herein by reference. The shaft includes mating channel members 28*a*, 28*b* that divide the surface of the shaft into two half sections and surround a square shaft 37. Short stub shafts 35, 35*a* project axially from opposite ends of shaft 37. A bearing 35*b* encircles stub shaft 35*a*, and a collar 35*c* is secured to the outer end of shaft 35*a*. A spring 61 is located between collar 35*b* and stub shaft 35*a*. A pulley 36 upon the outer end of stub shaft 35 forms part of the previously-described drive mechanism that drives delivery rolls 25 and shaft 28 of unit 5. Small channel members 28*e*, 28*f* are secured to the inner surfaces of channel members 28*a*, 28*b*. Square shaft 37 has guide holes or slots 37*a* that extend angularly upwardly in the same direction, and is also provided with guide holes or slots 37*b* that extend perpendicularly to the slots 37*a*.

Extendible and retractable combs 60 are provided at spaced intervals from each other along the length of shaft 28. When combs 60 are extended they project from openings 28*n* in the shaft 28, and the leading end of the fabric extending downwardly from knitting unit 2 is caught by the combs and thereby caused to adhere to shaft 28. When the fabric is to be removed from shaft 28, the combs are retracted into the interior of shaft 28.

The previously-mentioned guide holes or slots 37*a*, 37*b* are engaged by pins 60*a* fixed to each of the combs 60. Guide plates 28*c* associated with respective ones of combs 60 guide movement of the combs. Small channel members 28*e* have horizontal guide holes 28*g* and rightwardly ascending guide holes 28*h* running in the same direction, and also have guide holes 28*f* with horizontal guide holes 28*j* and rightwardly descending guide holes 28*k* running in the same direction. The horizontal guide holes and inclined holes or slots are each in engagement with pins 37*c* within square shaft 37.

When the channel members 28*a*, 28*b* move axially in a direction causing compression of spring 61, each comb 60 retracts from the surface of shaft 28 along inclined guide holes 37*a*, 37*b* and, at the same time, the cross-sectional dimension of the roll decreases. Consequently, the fabric wound upon shaft 28 may then be easily moved axially along and from shaft 28. When the fabric is removed from it, the surface of shaft 28 automatically moves so as to again cause combs 60 to project from the shaft and again grasp fabric delivered to the shaft.

Figure 4:
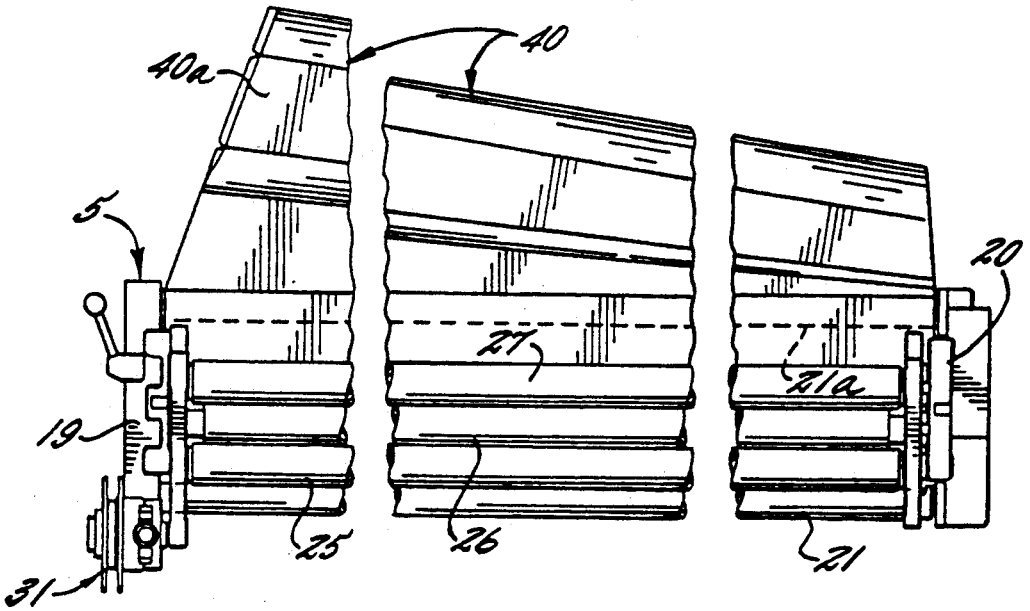
FIG. 4 is a foreshortened plan view of the winding unit of FIG. 3.

A fabric receiving table 40 (FIGS. 4, 5 and 21) is fixedly secured to the connecting bolts 21 of unit 5. The enlarged upper part of table 40 directs a roll 15 of fabric 24 dropped thereon along a desired path of travel. A recess 40*a* (FIG. 5) assists in retaining the roll of fabric 24 upon the table 40, and also assists in stabilizing the position of the fabric. A switch 41 associated with table 40 detects any failure in winding of the fabric upon shaft 28.

Figure 7:
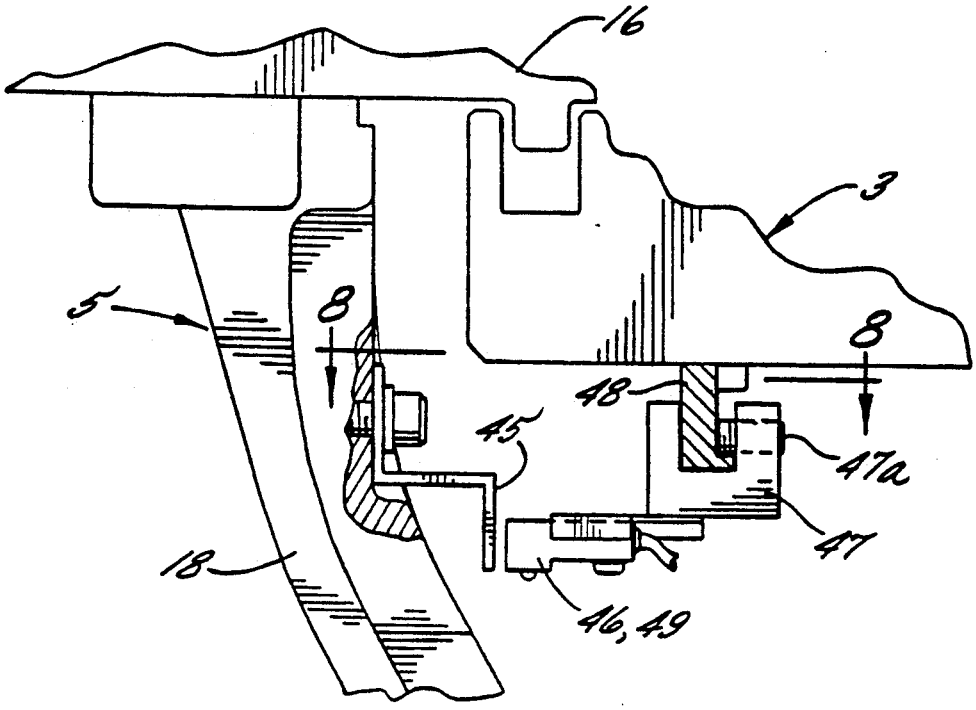
FIG. 7 is an enlarged fragmentary view of a position signalling switch and of a position confirming switch of the knitting machine.
Figure 8:
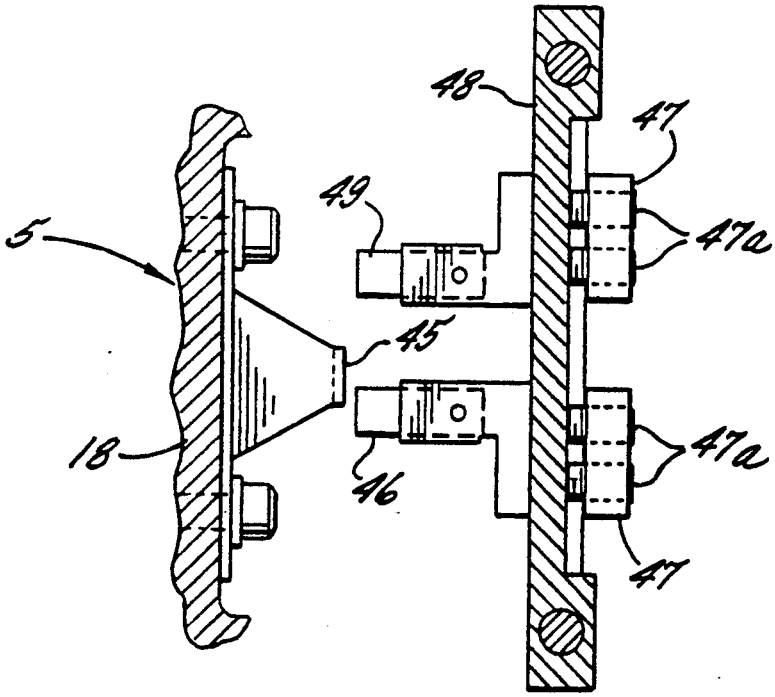
FIG. 8 is a plan view of the switches of FIG. 7.

As previously noted, the proximity switches 23 (FIG. 1) for detecting the knitting speed and revolution of the knitting machine are attached to the bottom of bed 3 and to driving bar 17, respectively. The fixed position stop switches 46, 49 (FIGS. 7 and 8) for stopping machine O at a fixed position are secured to driving bar 18 by a block 45. The switch 46 (FIG. 8) for stopping winding of fabric 24 onto shaft 28 is disposed opposite detecting block 45, along with the detecting switch 49 (FIG. 8) that confirms the stopped position of unit 5. Switches 46, 49 are secured to holders 47, 48, respectively, and their positions can be adjusted by rotation of adjustment screws 47*a*.

When a full roll 15 of fabric 24 has been wound, digital panel s (FIG. 1) emits control signals causing ACI panel 10 to reduce the rotational speed of the knitting machine and winding unit and detecting block 45 stops at a position slightly beyond detecting switch 46. Detecting switch 49 confirms whether detecting block 45 is in a fixed position. Confirmation of the fact that block 45 is lying in the range of detection signifies that the knitting machine is stopped at a fixed position.

Figure 9:
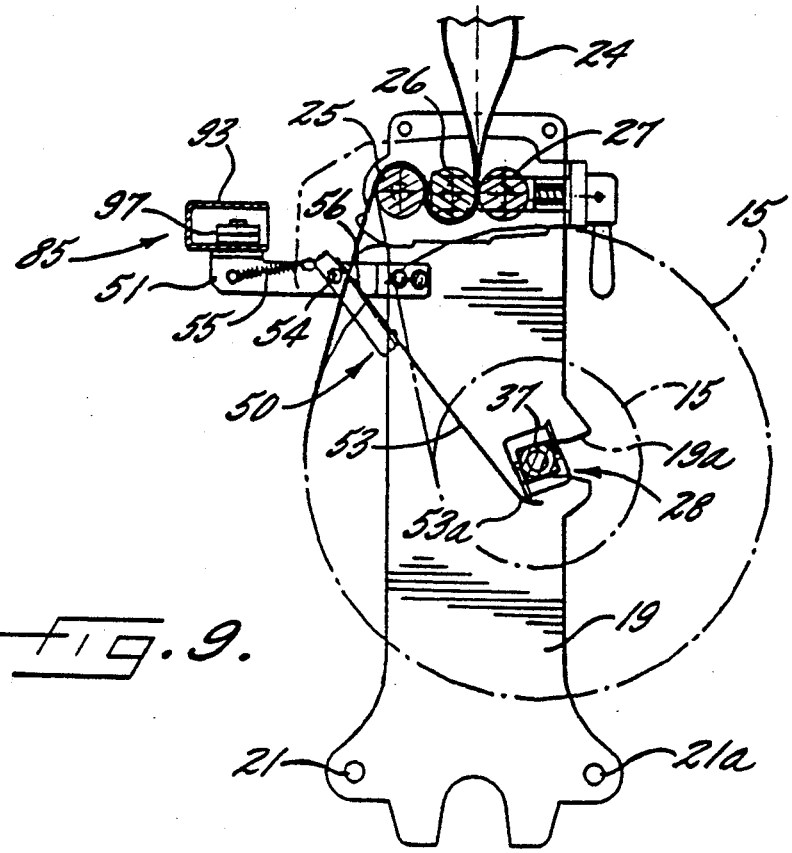
FIG. 9 is a side elevational view of a frame member, a fabric guide member and a fabric cutter of the winding unit.
Figure 10:
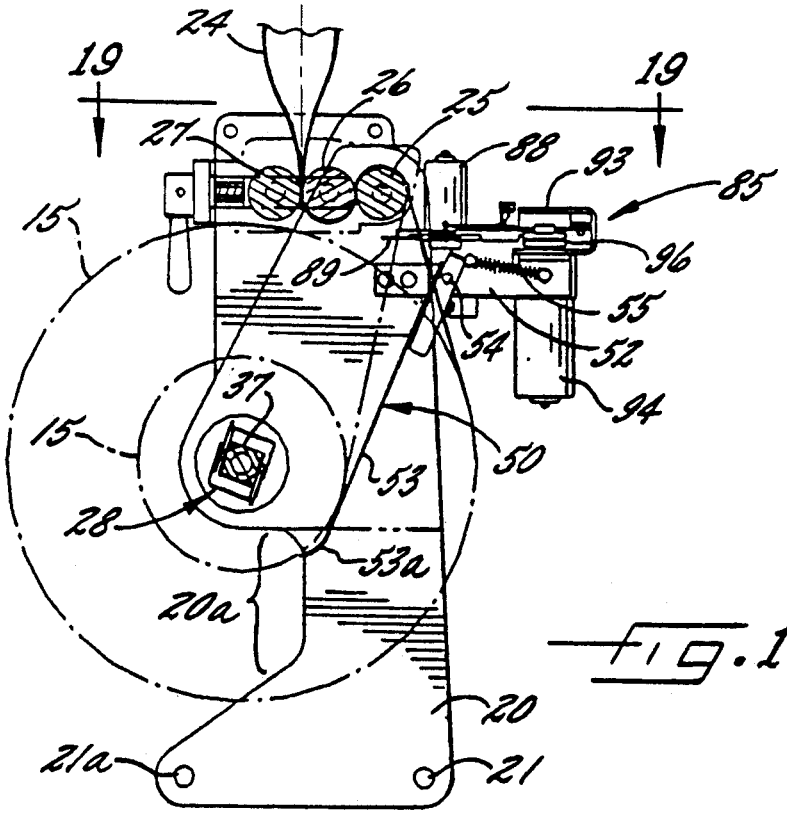
FIG. 10 is an opposite side elevational view of the components of FIG. 9, and of the opposite support plate of the winding unit.
Figure 11:
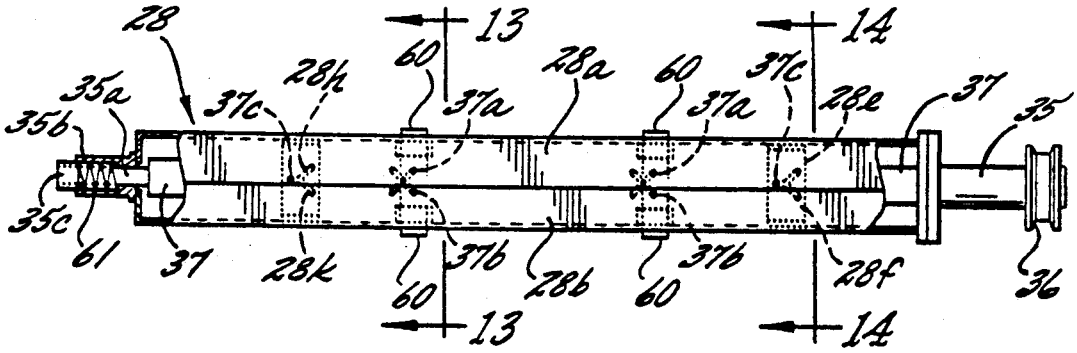
FIG. 11 is a partially broken away elevational view of an extendible and contractible center shaft of the winding unit.
Figure 12:
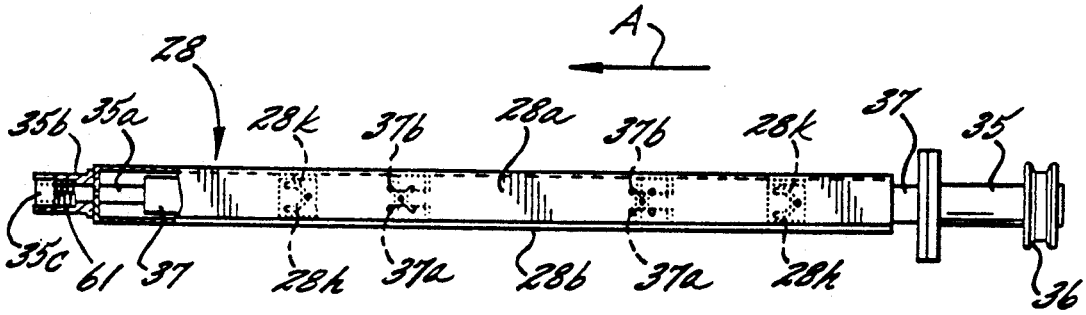
FIG. 12 is a partially broken away elevational view showing the shaft of FIG. 11 in a contracted condition.
Figure 13:
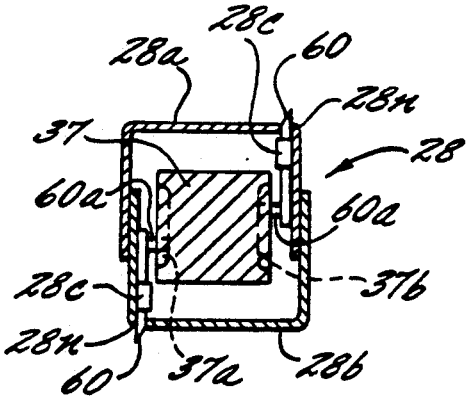
FIG. 13 is a sectional view taken through the center shaft along the lines and in the direction of the arrows 13—13 of FIG. 11.
Figure 14:
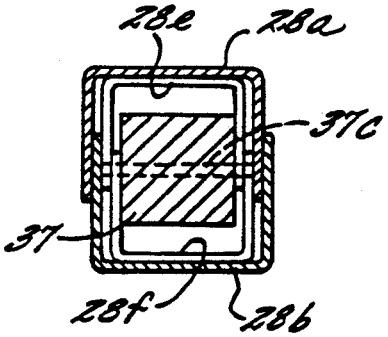
FIG. 14 is a sectional view taken along the line and in the direction of the arrows 14—14 of FIG. 11 through the center shaft.
Figure 15:
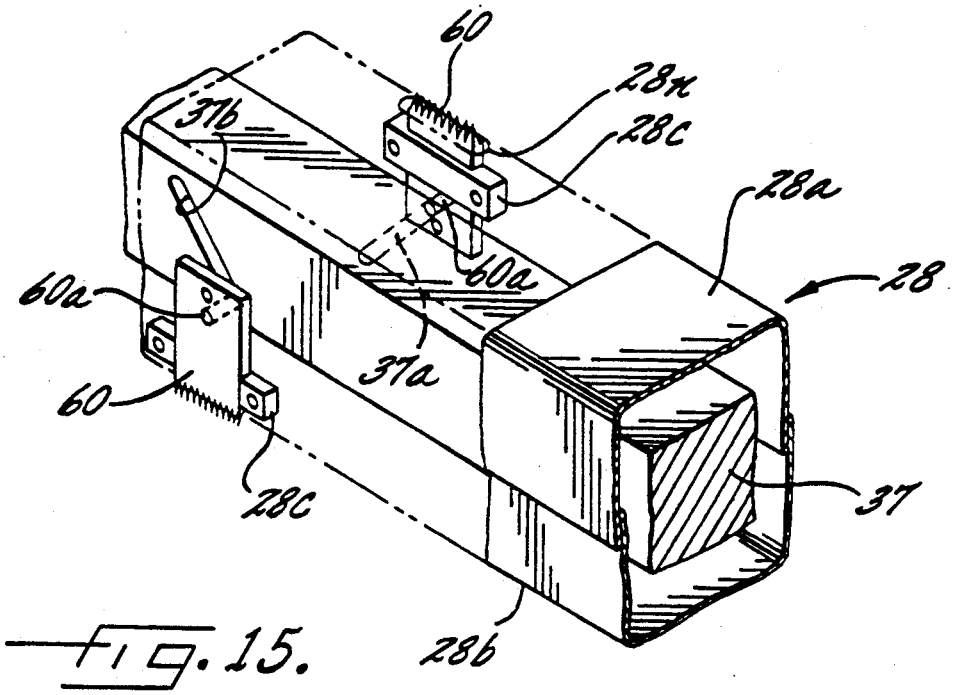
FIG. 15 is a fragmentary perspective view showing comb members of the center shaft in extended positions.
Figure 16:
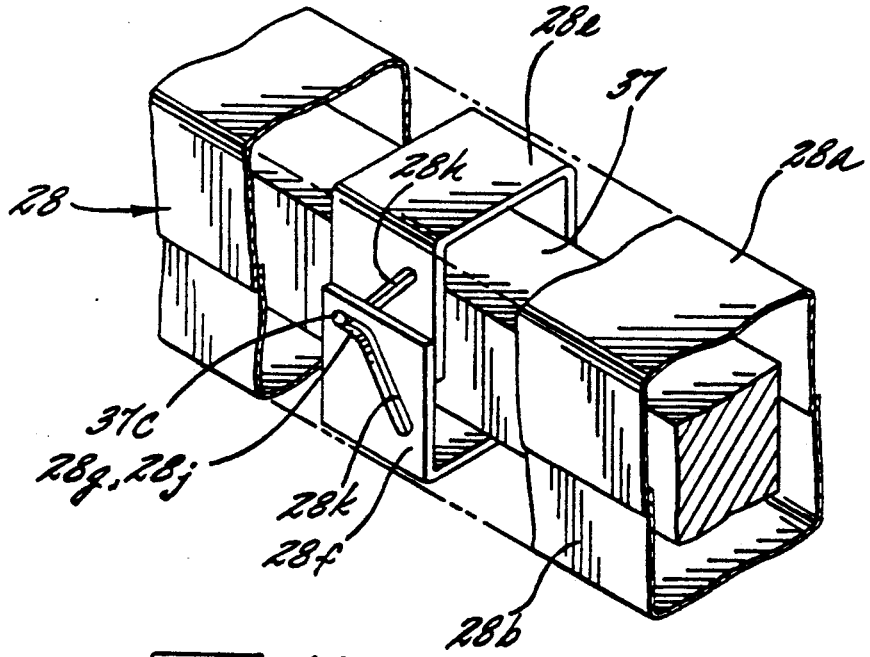
FIG. 16 is a fragmentary, perspective, partially broken away view of the center shaft of the winding unit.
Figure 19:
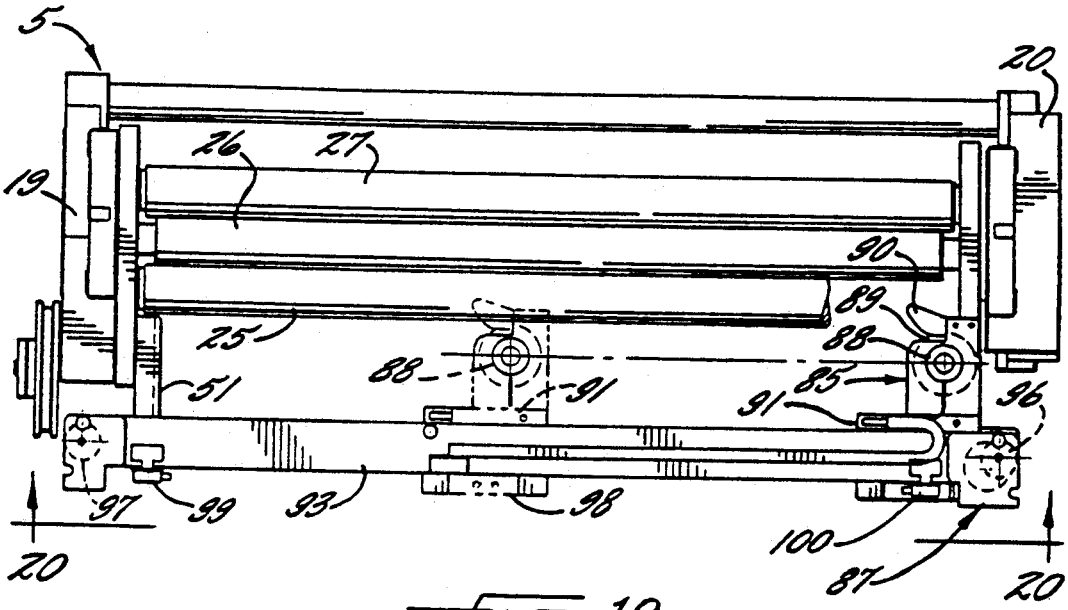
FIG. 19 is a plan view of a fabric cutter and adjacent components of the fabric winding unit.

A fabric cutting device 85 (FIGS. 9, 10, 19 and is mounted upon arms 51 connected to side frames 19, 20 of winding unit 5. Device 85 includes a circular cutter element 89, a drive motor 88, a guard element 90 and a cutter support member 91 that is attached to and movable along a rail 93 of device 85. A transmission mechanism for moving the foregoing components along the rail includes rotatable pulleys 96, 97 adjacent opposite ends of the rail, a wire 95 entrained about pulleys 96, 97 and connected to movable cutter support member 91, and a reversible motor 94 for imparting rotation to pulley 96 and for thereby effecting translatory movement of cutter element 89 and its drive motor 88 parallel to rail 93. A sensor plate 98 secured to cutter support member 91 cooperates with a microswitch 99 adjacent one end of rail 93 to detect the initial position of member 91. Another microswitch 100 adjacent the opposite end of rail 93 detects the terminal position of movable cutter support member 91. Confirmation of the operation of the fabric cutting device is realized by monitoring the amperage in motors 88, 94.

Referring now particularly to FIGS. 9 and 10, a fabric guiding device 50 guides the end of fabric 24 onto shaft 28 of winding unit 5. Device 50 is pivotally connected adjacent its upper end to arms 51, 52 that are secured to side frames 19, 20 of unit 5 by screws or other suitable fasteners 54. Springs 55 connected to upper end sections of fabric guide 50 bias the lower end portion of the guide toward shaft 28. The cut end of the fabric is guided by guide 50 to shaft 28 and is rolled upon the shaft. Switches upon respective ones of the arms 51, 52 detect the minimum dischargeable diameter of the fabric wound upon shaft 28.

Figure 17:
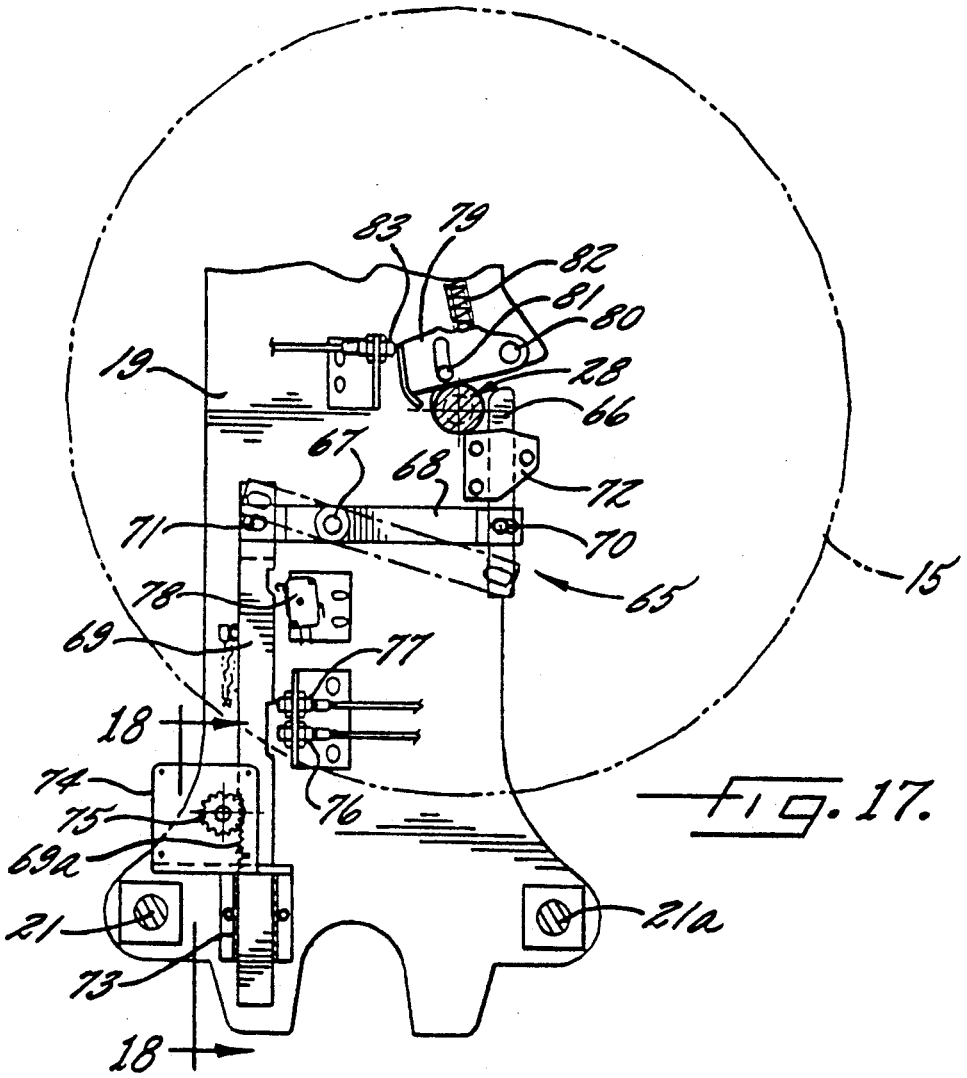
FIG. 17 is a vertically foreshortened elevational view of a side frame and components of a shaft latching/unlatching mechanism of the winding unit.
Figure 18:
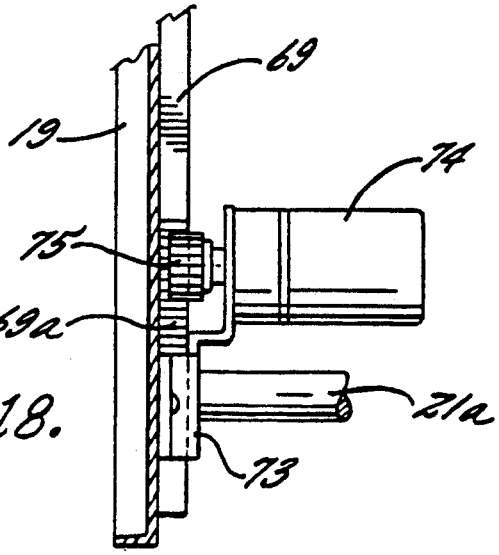
FIG. 18 is an elevational view of a drive motor and adjacent components of the mechanism shown in FIG. 17.

FIGS. 17-18 show a mechanism 65 for at times retaining the free end of shaft 28 of winding unit 5 in the C-shaped opening 19*a* (FIG. 5) of frame 19, and for at other times permitting passage of the shaft end from such opening. The mechanism includes a movable latch arm 66 and drive means for imparting movement to such arm. The drive means includes a motor 74 having a gear 75 fixed to its output shaft. Gear 75 meshes with gear teeth 69*a* upon a linkage member 69 that is supported for vertical movement by a guide block 73. Linkage member 69 is connected by a pin 71 to a linkage member 68 that is pivotal about a pivot member 67. The opposite (right, as viewed in FIG. 17) end of lever 68 is connected by a pin 70 to the lower end of movable latch arm 66, which is mounted for vertical movement by a guide block 72. When the upper section of arm 66 is in its upper position of FIG. 17, the arm retains the adjacent end portion of shaft 28 in opening 19*a*. Movement of movable latch arm 66 downwardly, in response to rotation in the appropriate direction of the gear 75 of motor 74, permits passage of the end of shaft 28 from the C-shaped opening. A proximity switch 77 adjacent linkage member 69 indicates when linkage member 69 occupies its initial position. Another proximity switch 76 indicates when linkage member 69 occupies its terminal position, and a switch 78 confirms the latter position of the linkage member. A detecting lever 79 pivotable about a pivot 80 detects when shaft 28, is held in place and when it is released by arm 66. Rotation of lever 79 about a pivot 80 is limited by a stop pin 81. The forward (rightward, as viewed in FIG. 17) end of lever 79 is biased downwardly by a spring 82 when shaft 28 is not supported by frame members 19, 20. When the shaft is supported by the frame members, lever 79 is displaced upwardly in opposition to the force of spring 82, and the aforesaid upward displacement is detected by a proximity switch 83.

Figure 21:
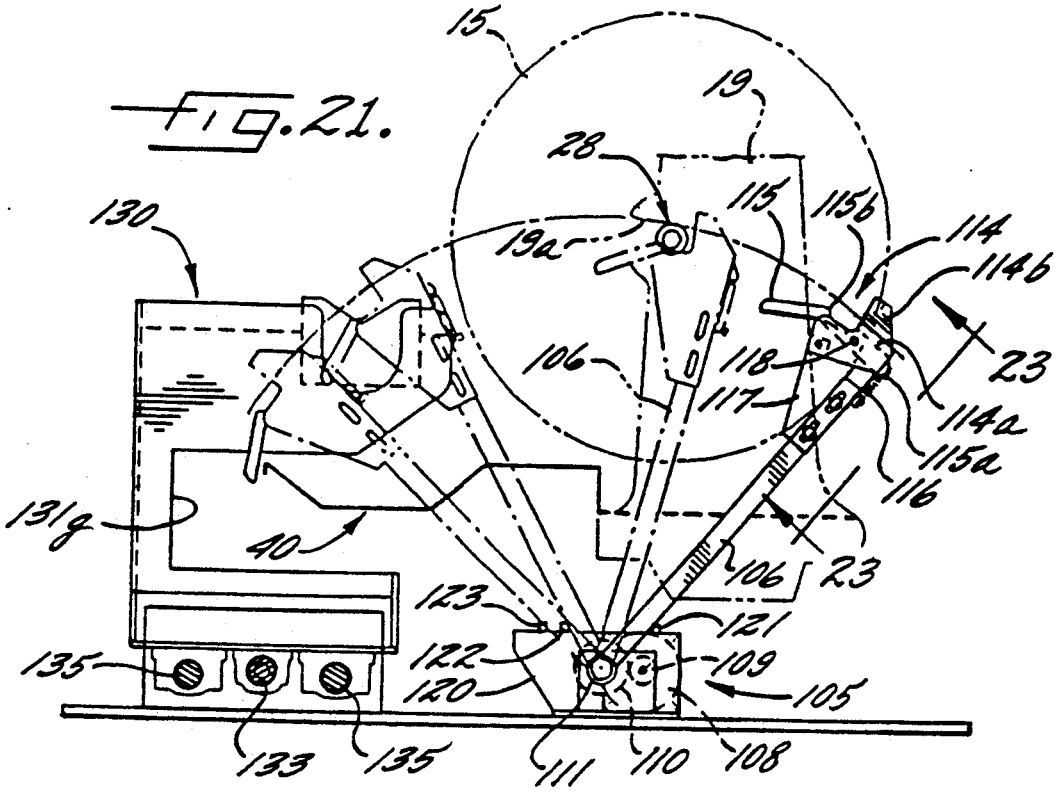
FIG. 21 is a side elevational view of a mechanism for transporting the center shaft of the winding unit to and from a fabric receiving table, and of a thruster mechanism.
Figure 22:
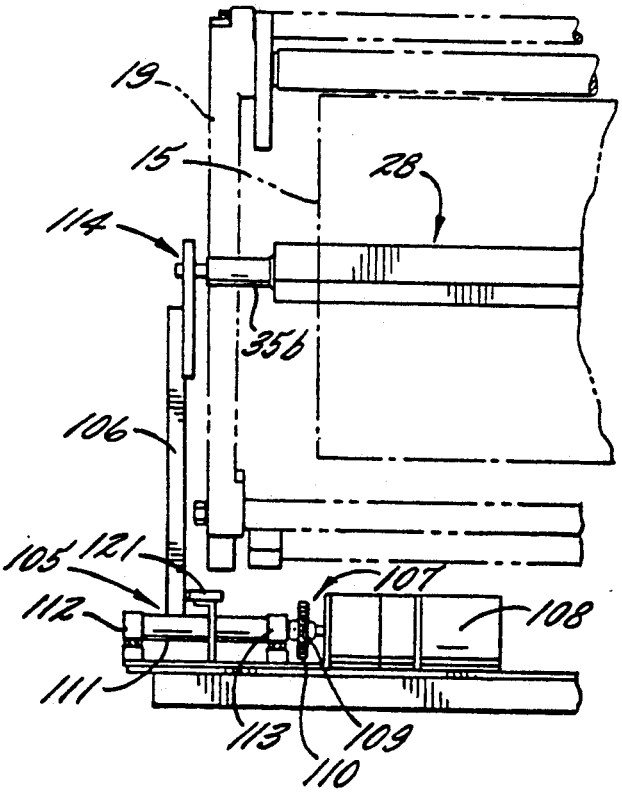
FIG. 22 is a fragmentary, elevational view of drive components of the mechanism of FIG. 21.
Figure 23:
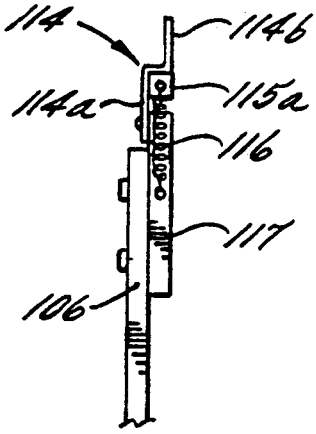
FIG. 23 is an enlarged elevational view, taken in the direction of the arrows 23—23 of FIG. 22 of components of the mechanism of FIG. 22.
Figure 24:
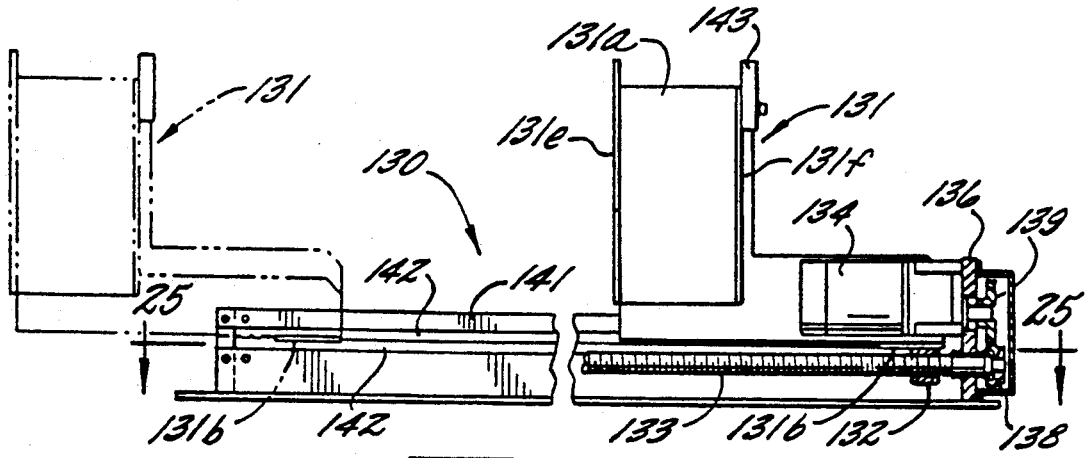
FIG. 24 is a foreshortened elevational view of a thruster mechanism of the winding unit, a movable member of the mechanism being shown in a retracted position by solid lines, and in an extended position by phantom lines.

FIGS. 21-23 show a mechanism 105 for at desired times moving the free end of winding unit shaft 28 from the opening 19*a* of frame member 19 and toward fabric receiving table 40. The mechanism includes a movable arm 106 and drive means for imparting pivotal movement to such arm. The drive means includes a motor 108 having a output gear 109 that turns a shaft 111 that is supported by bearings 112, 113. The lower end of arm 106 is attached to and pivotal about the central axis of shaft 111. A hook-shaped member 114 adjacent the upper end of arm 106 is secured to a triangular member 117 of arm 106. Member 114 has a section 114*a* of inverted L shape for moving the free end of shaft 28 from opening 19*a* of frame member 19, and has a Cutaway section 114*b* connected to section 114*a*. A latch 115 in section 114*b* is pivotable about a pin 118. A spring 116 has one end secured to latch 115, and has its opposite end secured to member 117. The spring biases the latch to a closed position.

Proximity switches 121, 122 and 123 upon a holder 120 between bearings 112, 113 detect the respective initial, medial and terminal positions of arm 106.

When unit 5 stops at a fixed stop position, arm 106 pivots into engagement with the free end of center shaft 28 and then moves the free end of shaft 28 from the C-shaped opening 19*a* (FIG. 5) of frame 19 of unit 5. When the free end portion of center shaft 28 is subsequently again placed in C-shaped opening 19*a*, member 115 is raised so as to prevent inadvertent passage of roll 28 from opening 19*a*.

Figure 20:
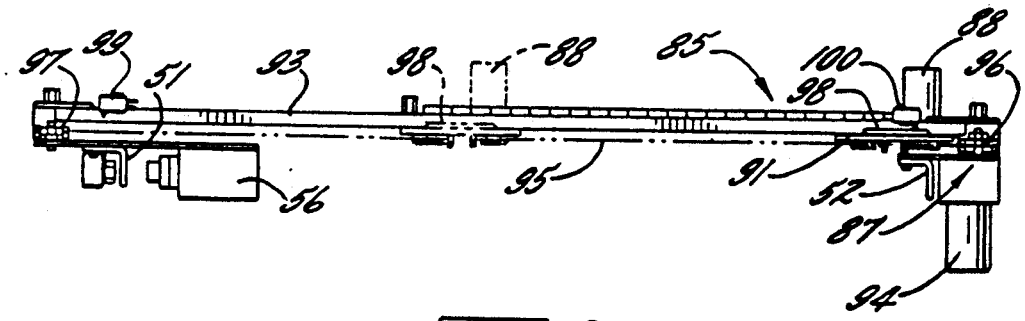
FIG. 20 is an elevational view of the fabric cutter as viewed in the direction of the arrows 20 of FIG. 19.
Figure 25:
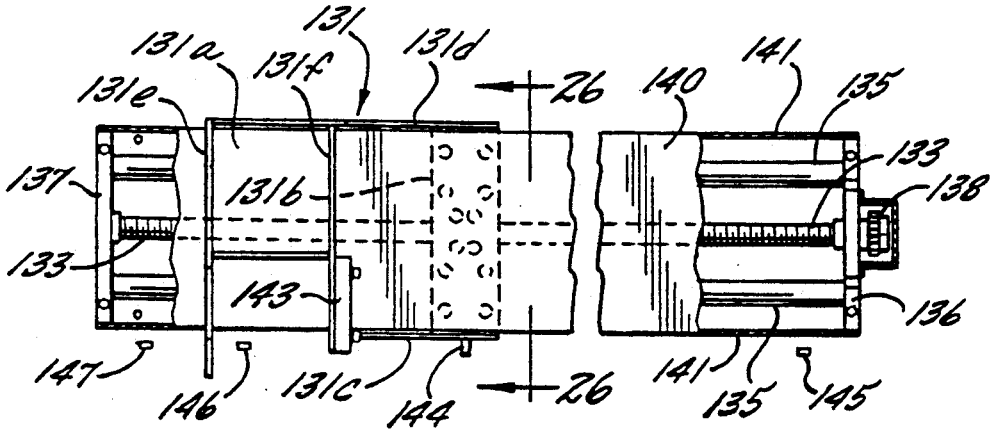
FIG. 25 is a plan view, taken in the direction of the arrows 25—25 of FIG. 24, of components of the thruster mechanism.
Figure 26:
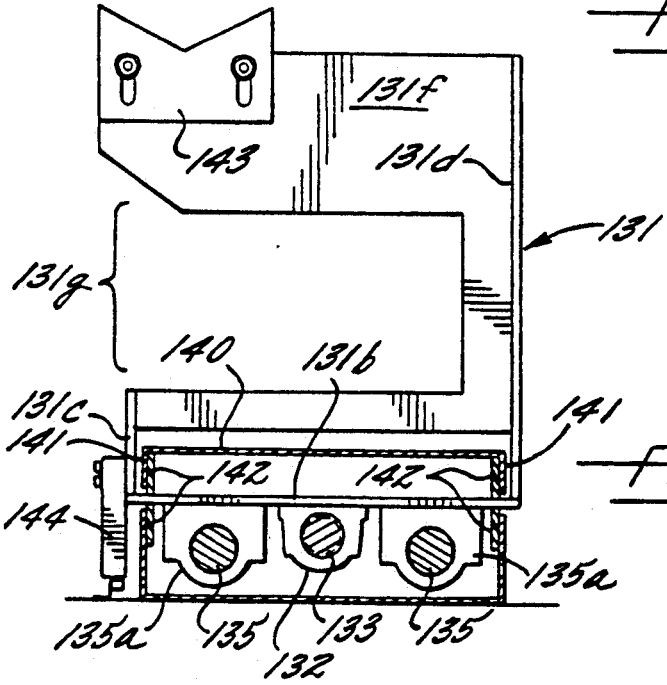
FIG. 26 is a view taken in the direction of the arrows 26—26 of FIG. 25 and showing, partially in elevation and partially in vertical section, components of the thruster mechanism.

Referring now particularly to FIGS. 21 and 24-26, a fabric pushing device 130 within the lower part of windinq unit 5 includes a pusher unit 131 that engages and pushes an end of each roll of fabric 24 so as to discharge it from knitting machine O; an internally threaded part 132 that is fixed to pusher 131; an externally threaded shaft 133 that mates with and extends through part 132, and a motor 134 that drives shaft 133. Two guide bars 135 (FIG. 19) extend in parallel relationship to threaded shaft 133 through guide blocks 135*a* (FIG. 20) supported by support members 136, 137 (FIG. 25). pusher 131 is movable between members 136, 137. A gear 138 (FIG. 24) fixed to one end of screw shaft 133 at a location beyond supporting member 136 meshes with a gear 139 fixed to the output shaft of motor 134. Motor 134 is secured to the inner surface of supporting member 136. A Channel shaped cover 140 and angle members 141 are fixed to the top and sides of members 136, 137. Members 140, 141 are shielded by plastic sheets (not shown) at both ends so as to prevent entry of fiber waste and the like into pusher 131. Pusher 131 is of inverted "L" shape, as viewed in side elevation, and the upright part thereof forms a box 131*a* (FIG. 25). A bottom plate 131*b* having an internally threaded member 132 and guide blocks 135*a* (FIG. 26) are fixed to pusher 131. Also fixed to pusher 131 are guide arms 131*c*, 131*d*; a front plate 131*e* that at desired times engages and pushes the rolled fabric 15; and a rear plate 131*f*.

Space 131*g* (FIG. 26) in front plate 131*e* and rear plate 131*f* prevents the plates from touching the rolled fabric receiving table 40 previously described. A V-shaped block 143 (FIGS. 24 and 26) for positioning the free end of center shaft 28 of fabric winding unit 5, after ejection of a roll 15 of fabric 24, is adjustably secured to rear plate 131*f*.

A sensor block 144 (FIG. 26) fixed to pusher 131 faces proximity switches 145, 146 and 147 (FIG. 25) that respectively detect the initial, medial, and terminal positions of pusher 131.

Figure 27:
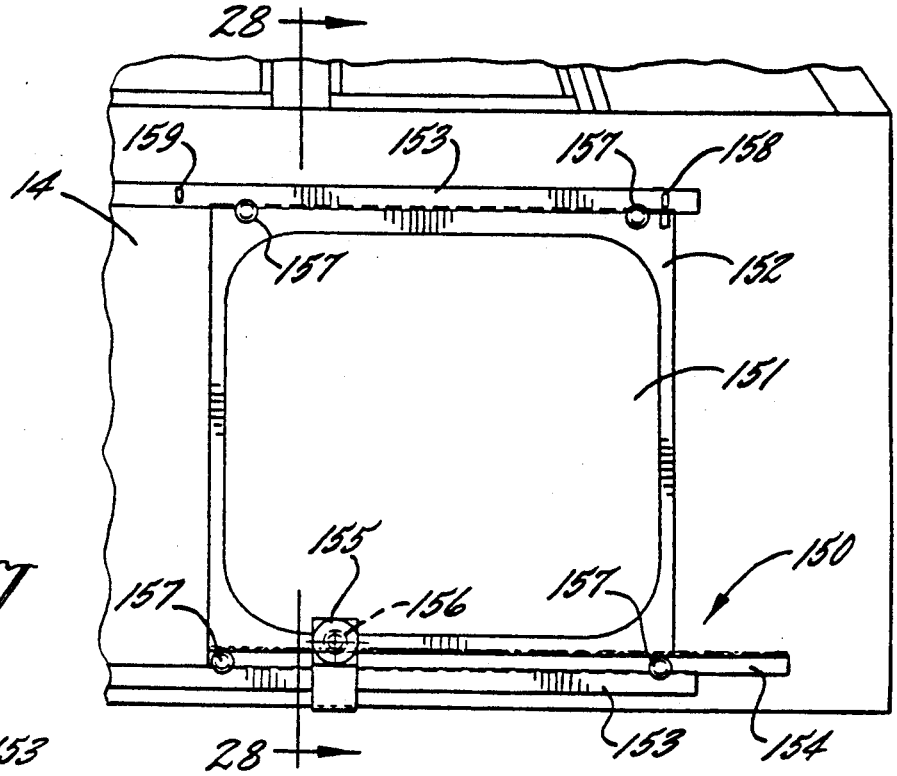
FIG. 27 is an elevational view of a movable gate through which wound fabric is discharged.
Figure 28:
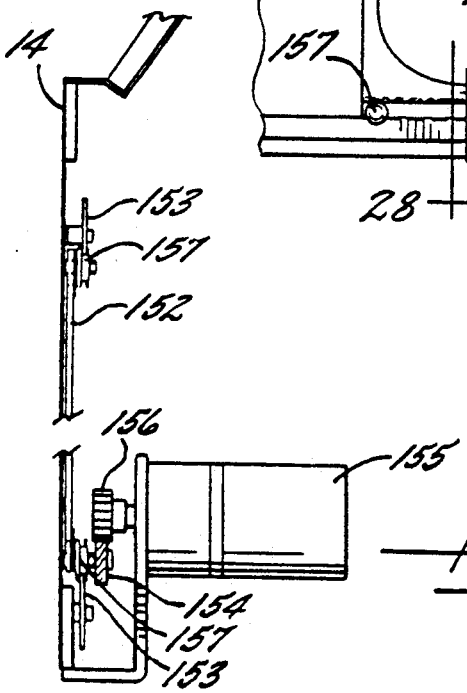
FIG. 28 is a view taken in the direction of the arrows 28—28 of FIG. 17 and showing, partially in vertical section and partially in elevation, drive and other components of the gate.

FIG. 27 is a fragmentary rear elevational view of the gate 152 associated with the guard net 14 shown in FIG. 2. Gate 152 has rollers 157 that engage upper and lower rails 153 forming part of a gate opening/closing device 150 and that support the gate 152 for movement into and out of registry with an opening 151 of the guard net. Gate plate 152 is driven by a rack 154 (FIG. 28) fixed to the lower part of the gate and meshing with a gear 156 upon the output shaft of a motor 155 fixed to guard net 14. Proximity switches 158, 159 (FIG. 27) upon upper rail 153 monitor the respective initial and terminal positions of gate 152.

A power supply unit 160 best shown in FIGS. 3 and 29 fixed to stationary bevel gear 29*a* supplies electricity to the previously described motors, switches and other electrically powered devices of rotating unit 5. Unit 60 includes a casing 164 secured in a hub 165 by screws 166. Unit 60 also includes a contact ring 161, a brush assembly 162, and a tubular center shaft 163 that is prevented from rotation by a pin 169 in a recess 171. Upper and lower cover members 167, 170 respectively overlie and underlie casing 164. Electricity is conducted to unit 60 by a cable 168, and is conducted from the unit to the various electric motor, etc.. of unit 5 via a cable 172.

Figure 30:
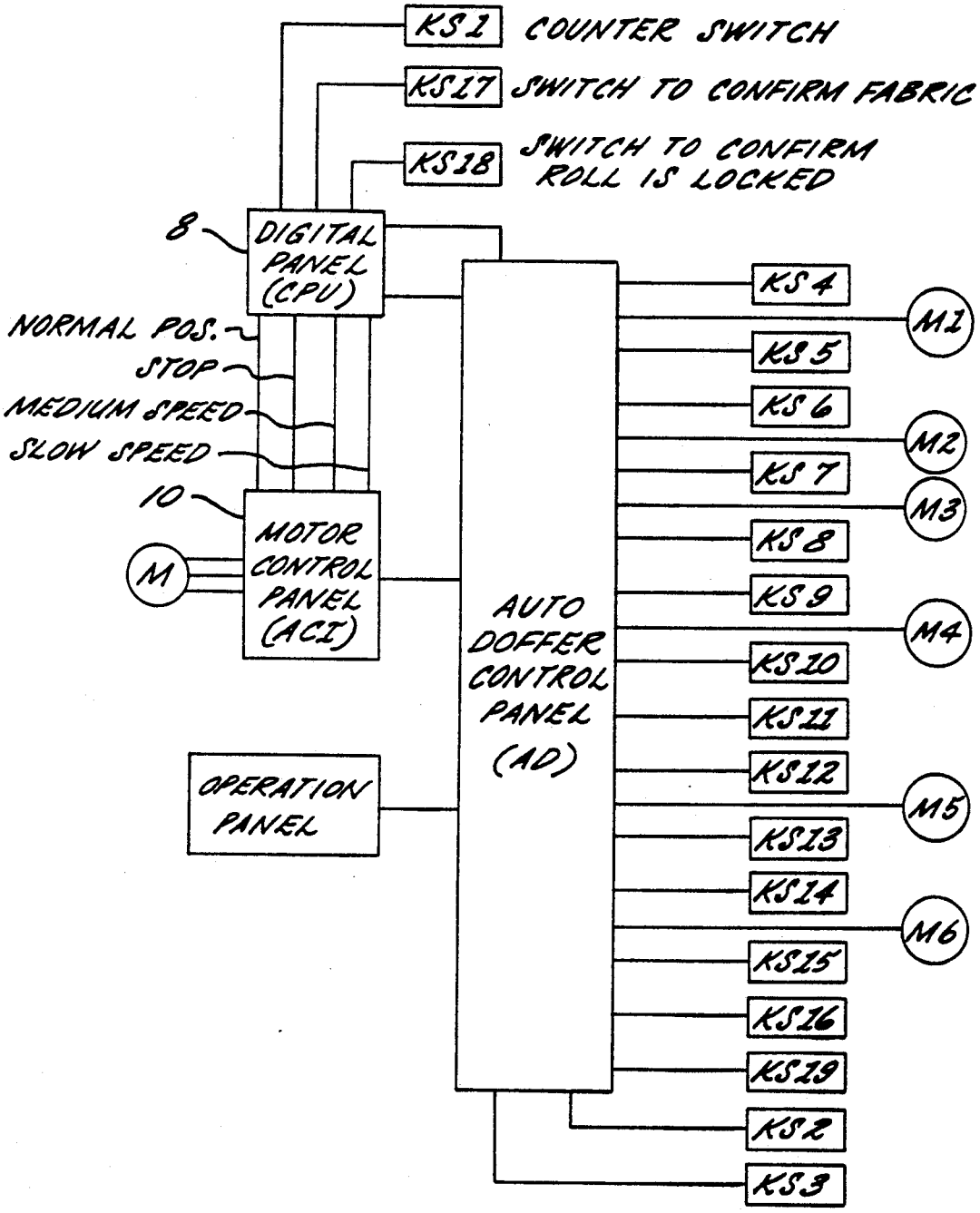
FIG. 30 is a block diagram of control components of the knitting machine and winding unit.
Figure 31A:
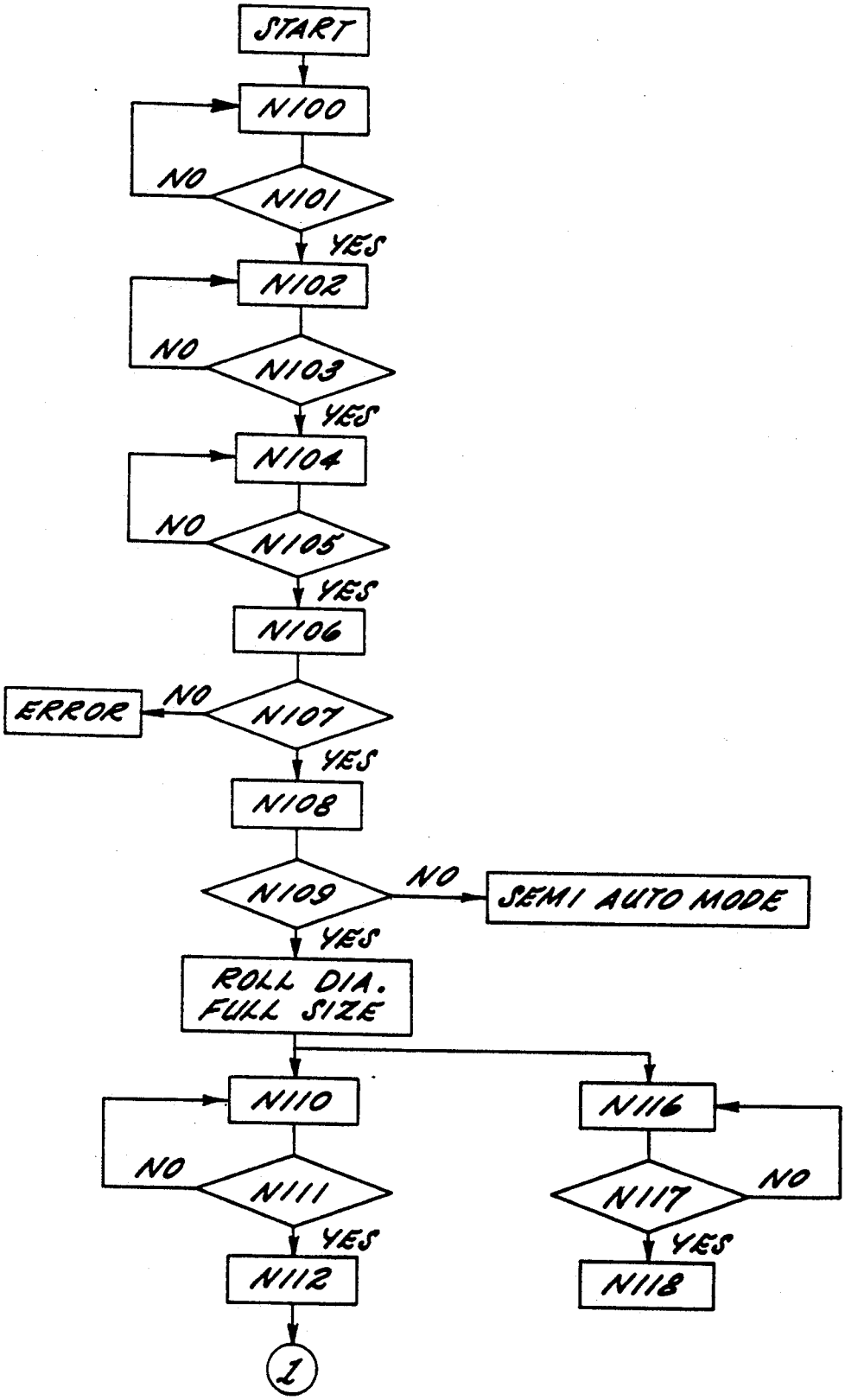
FIG. 31A is a flow chart showing steps in the operation of components associated with the fabric winding unit.
Figure 31B:
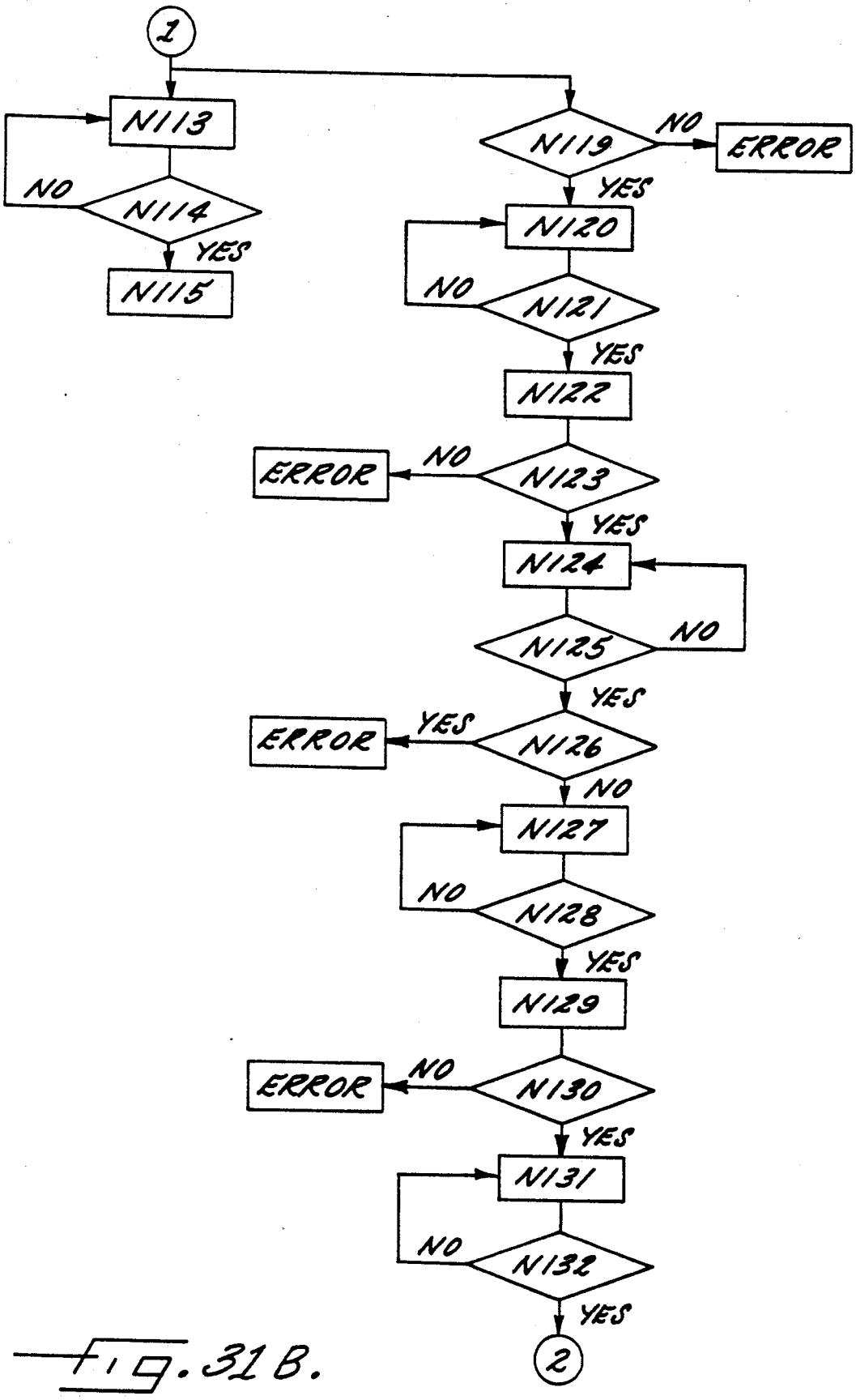
FIG. 31B is a continuation of the flow chart of FIG. 31A.
Figure 31C:
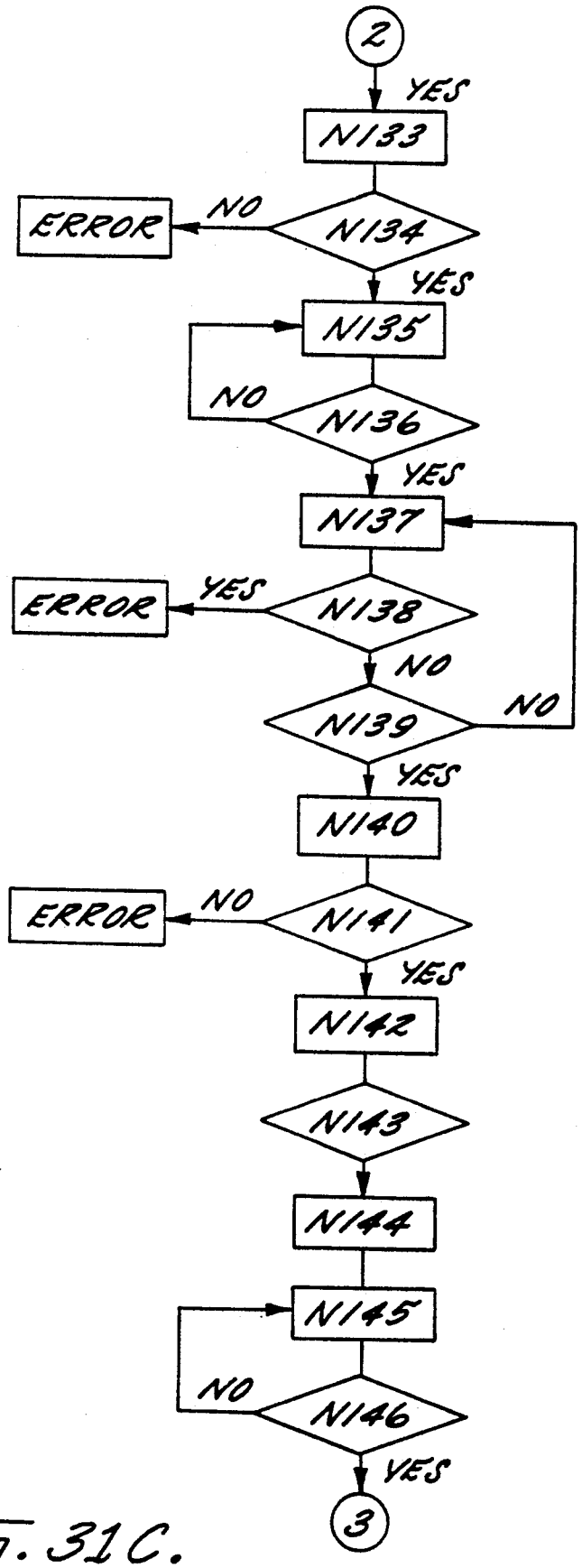
FIG. 31C is a continuation of the flow chart of FIG. 31B.
Figure 31D:
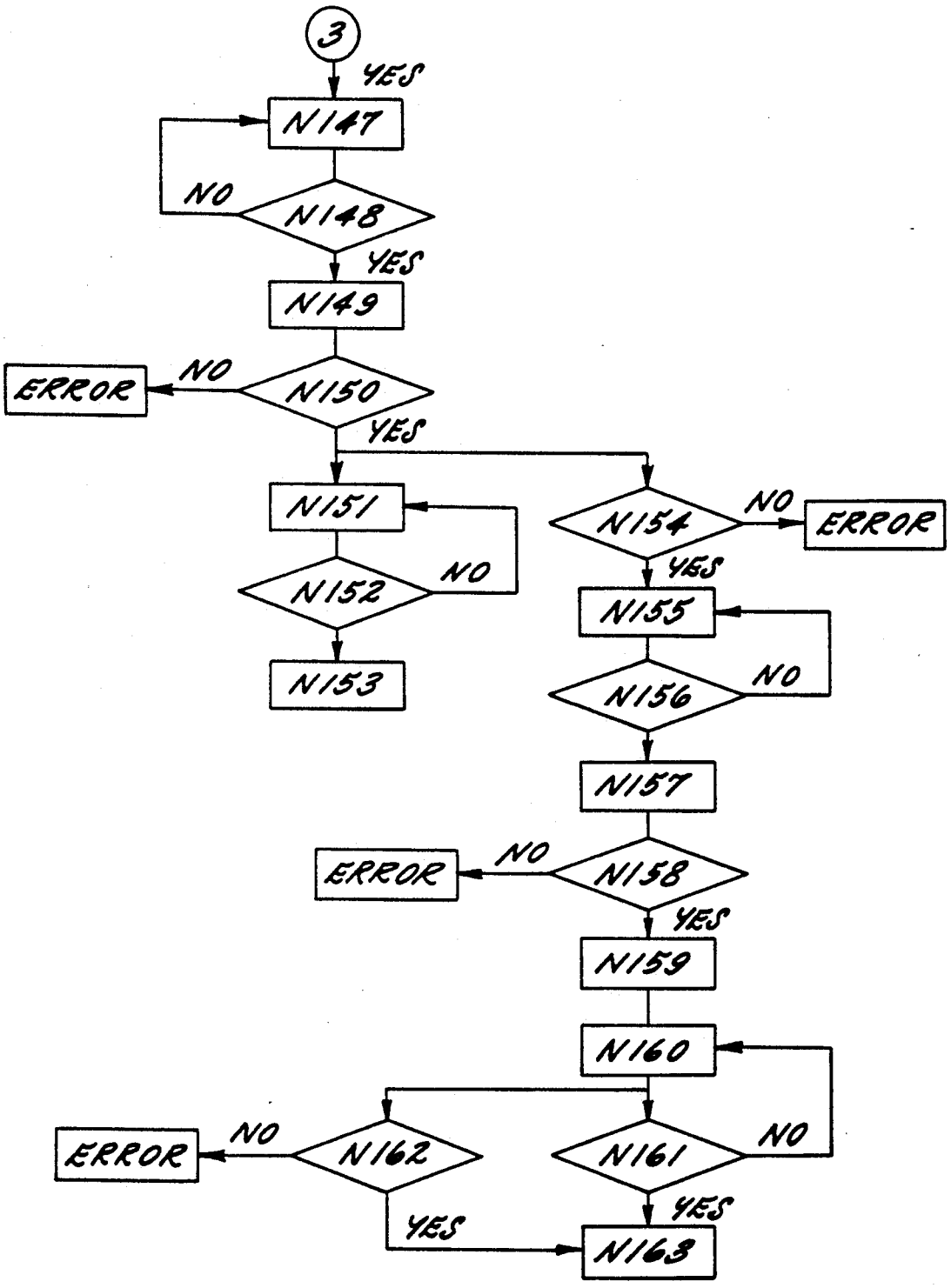
FIG. 31D is a continuation of the flow chart of FIG. 31C.

FIG. 30 is a block diagram of the route of signal transmission employed in the method of controlling the apparatus of the invention. The numeral s designates a central processing unit (CPU) having a ten-key console digital panel and having means for inputting preset values and speed control to the motor of the knitting machine, function keys, monitor and a trouble position detecting lamp.

Central processing unit s conducts signal processing in accordance with a control program input. As is indicated at the top of FIG. 30, such input is supplied in part by switches KS1, KS17 and KS18 that count the revolutions of the knitting machine, confirm the presence of fabric, and confirm that shaft 28 is secured in place. CPU 8 is connected to ACI panel 10. ACI panel 10 and auto doffer (AD) panel 170 are connected to each other. ACI panel 10 is connected to and controls the main motor M7 of the knitting machine.

Connected to AD panel 170 are proximity switches KS4 (initial position) and KS5 (terminal position) for confirming positions of opening/closure of the gate; a line for controlling operation of gate opening/closing motor M1; proximity switches KS6 (initial position) and KS7 (terminal position) for confirming the position of the fabric cutting device; lines for controlling operation of the motor M3 that moves the fabric cutter; for controlling operation of cutter motor M2; proximity switches KS8 (initial position), KS9 (medial position), and S10 (terminal position) for confirming a position to which the thrusting device is driven; a line for controlling operation of a motor M5 for driving thrusting device 130; proximity switches KS11 (initial position), KS12 (midway position), and KS13 (terminal position) for confirming movement of arm 106; a line for controlling the driving motor arm for latching and releasing the fabric winding shaft; proximity switches KS14 (initial position) and KS15 (midway position) for confirming the condition of the locking/unlocking device; a line controlling operation of motor M6 to drive the locking/unlocking device; a proximity switch KS2 for stopping the winding unit at a fixed position; a proximity switch KS3 for confirming whether the winding unit stops at a fixed position; a switch KS19 for confirming the presence of winding shaft 28 in the winding unit; and a switch KS16 for confirming the diameter of the rolled fabric.

A switch KS17 for detecting failure in winding of the fabric, and a switch KS18 for confirming that the center shaft 28 roll is locked, are connected to the digital panel of CPU 8. After completion of the operation of a series of devices connected to the AD panel 170, a signal denoting completion of a doffing operation is transmitted to the digital panel.

If any trouble occurs in devices connected to the AD panel and on the side of the knitting machine when the mode of operation of the knitting machine is changed from medium/low speed rotation to doffing, doffing standby signals (wait) are transmitted to a series of devices connected to AD panel 170. ACI panel 10 receives signals indicating rotation of the knitting machine cylinder from the digital panel 8 and AD panel 170.

Signals from the proximity switch KS1 for detecting the knitting speed/revolution of the knitting machine are transmitted to the CPU of digital panel 8 for computing speed/revolution of the machine.

The output side of the CPU is connected to the main motor of the knitting machine proper through the ACI panel 10. Signals from proximity switch KS1 control the motor of the knitting machine proper in three steps as, for example, normal, medium, and low speed with the ROM incorporated into the ACI panel and programmed beforehand.

The proximity switch KS1 is connected to the AD panel 170 through the digital panel of CPU 8. Revolution of the knitting machine are detected by the proximity switch KS1, and when the revolution reach a preset value, fully rolled fabric signals are transmitted to the digital panel, and to the ACI panel 10, as speed control signals.

Speed control signals are transmitted to the main knitting machine motor connected to the output side of the ACI panel 10 as retardation signals and the knitting machine speed is limited to medium and low speeds and is stopped by the proximity switch KS2. Upon stopping of the knitting machine, the proximity switch KS3 detects whether the winding unit 5 is stopped at a fixed position and fixed position stop signals are transmitted to the AD panel. The fixed position stop signals transmitted to the AD panel are transmitted to a device connected to the output side of said panel, which device then starts to operate pursuant to a program for a series of devices.

The switch KS17 for confirming Whether the fabric is rolled on center shaft 28 is connected to the digital panel of CPU 8. When the fabric fails to be rolled on the shaft 28, the switch KS17 operates and stop signals are transmitted to the digital panel for stopping the motor through the ACI panel 10.

An operation panel (FIG. 30) connected to ACI panel 10 services an auto-doffing operation in which a series of devices are automatically operated; semiautomatic doffing in which devices are individually operated; and manual doffing in which occurrence of an error is detected and confirmed.

Flow Chart of Actions of Fabric Discharging Device

Operation of the fabric discharging device of the knitting machine of this invention is described with reference to the flow chart of FIGS. 31A-31D, wherein the reference numbers N100 through N200 indicate sequential steps.

In step N100, operation of the circular knitting machine is started and a preset counter of the digital panel starts counting. The proximity switch KS1 inputs signals of counted revolution of the knitting machine into CPU 8. An integrated value of revolution of the knitting machine is compared and processed according to a preselected program.

In steps N101, N102, it is determined whether the revolution of the knitting machine have reached a value one less than the preset value and, when the revolution are one less than the first preset value, the motor speed is retarded by a medium speed rotation instruction from the ACI panel 10, whereby the knitting machine is driven at a medium speed. When the revolution has not reached an expected value, the knitting machine continues rotating.

In steps N103, N104, it is determined whether the revolution of the knitting machine have reached a second preset value and, when said value is reached, the motor is retarded by a retardation instruction from the ACI panel 10, which reduces the medium speed driving mode to a low speed mode. If the knitting machine revolution has not reached the second preset value, it continues rotating at medium speed.

In steps N105, N106, the proximity switch KS2 stops the winding unit at a fixed position and, in the steps N107, N108, the proximity switch KS3 determines and confirms whether the knitting machine is stopped at a fixed position.

In step N109, when the diameter of the rolled fabric is judged as equaling or exceeding 200 mm, the operation is switched to full automatic doffing. When the diameter has not reached 200 mm, the fabric is checked at the semi-auto doffing operation.

In steps N110, N111, and N112, the knitted fabric is cut by operation of cutter motor M2 and shifting motor M3. The proximity switch KS7 in the terminal position then stops the cutter motor M2 and shifting motor M3.

In steps N113, N114, and N115, the motor M3 is driven in the reverse direction until stopped by the proximity switch KS6 disposed in the initial position of motor M3.

In steps N116, N117, and N118, the motor Ml for opening and closing the gate is driven and stopped by the proximity switch KS5 disposed in the terminal position for opening the gate.

In step N119 stoppage of the knitting machine at a fixed position is determined by the proximity switch KS3 for confirming such stoppage. When the machine halts in the fixed position, the following step is started. When halting of the machine is not determined as above, an error indication is displayed.

In steps N120, N121, and N122, the motor M6 for shifting the center shaft 28 is rotated to unlock the shaft, and is stopped by the proximity switch KS15 located in the terminal position.

In step N123 the presence of the shaft 28 is confirmed by switch KS19 and the following step is started. When the presence of shaft 28 is not confirmed, an error indication is displayed.

In steps N124, N125 and N126 the motor M5 for shifting the movable arm 106 is driven, the rolled fabric falls on the fabric receiving table 40, the motor M5 is rotated in the reverse direction, absence of shaft 28 is confirmed by the confirming switch KS19, and the following step is started. When the presence of shaft 28 is confirmed, an error indication is displayed.

In steps N127, N128 and N129 shifting motor M5 is rotated in the reverse direction and is stopped by the proximity switch KS11 disposed in the initial position.

In step N130 when the proximity switch KS5 in the terminal position determines that the gate is open, the following step is started. When the gate is not in the position corresponding to the proximity switch KS5, an error indication is displayed.

In steps N131, N132, and N133 the motor M4 for pushing the rolled fabric placed on the rolled fabric receiving table 40 by the pusher 131 is driven until stopped by the proximity switch KS9 in the midway position.

In step N134 confirming switch KS19 confirms absence of the shaft 28 and the following step is started. When the presence of shaft 28 is confirmed, an error indication is displayed.

In steps N135, N136, and N137, the motor M5 for pivoting movable arm 106 is driven in a forward direction, and then in a reverse direction until stopped by proximity switch KS12 in the midway position.

In step N138 proximity switch KS15 confirms that shaft 28 is unlatched and the following step is started. When shaft 28 is not confirmed as being unlatched, an error indication is displayed.

In steps N139 and N140 the motor M5 is stopped by the proximity switch KS11 in the initial position.

In step N141 the switch KS19 confirms the presence of shaft 28 and the following step is started. When the presence of shaft 28 is not confirmed, an error indication is displayed.

In steps N142, N143, and N144 the thrusting motor M4 stops in the midway position, is driven in the reverse direction while a timer is in operation, and then is driven in the forward direction.

In steps N145 and N146 the thrusting motor M4 advances while rotating in the forward direction, the rolled fabric is discharged outside the machine, and the motor M4 is rotated in the reverse direction by the proximity switch KS10 in the terminal position.

In steps N147, N148 and N149 the thrusting motor M4 withdraws while rotating in the reverse direction and is stopped by the proximity switch KS8 in the initial position.

In step N150 the proximity switch KS8 confirms that the pusher 131 is in the initial position and the following step is started When the pusher position is not so confirmed, an error indication is displayed.

In steps N151, N152 and N153 the gate opening and closing motor M1 is driven in the reverse direction until stopped by the proximity switch KS4 for closing the gate.

In step N154 confirmation switch KS19 confirms that shaft 28 is present and the following step is started. When the presence of shaft 28 is not confirmed, an error indication is displayed.

In steps N155, N156 and N157 the motor M6 that unlatches shaft 28 is rotated in the reverse direction until stopped by the proximity switch KS14 in the initial position.

In step N158 the fixed position confirming switch KS3, gate opening/closing initial position switch KS5, cutter feeding initial position switch KS6, thrusting initial position switch KS8, shiftable arm initial position switch KS11, unlocking initial position switch KS14, improper winding detecting switch KS17, locking confirming switch KS18, and reel roll confirming switch KS19 are confirmed, and then the following step is started.

In step N159 a count value in the digital panel is automatically reset.

In steps N160, N161, N162 and N163 the knitting machine is started and driven at medium speed, which is confirmed by the confirmation switch KS18, until a count value set in the digital panel 8 is reached. When a value exceeds the preset one, the machine is accelerated and runs at normal speed.

Although specific embodiments of the invention have been shown and described, this was purposes of illustration only, and not for purposes of limitation, the scope of the invention being in accordance with the following claims.

I claim:

1. A fabric winding and discharge unit for a circular knitting machine having a knitting section including a rotatable needle cylinder, said unit being in spaced underlying relationship to said needle cylinder and being rotatable synchronously therewith about a central axis of said knitting machine;

said unit including a rotatable shaft about which the fabric is wound, a plurality of fabric delivery rolls for conducting a free end of said fabric to said shaft, and transmission means for driving said delivery rolls and said shaft in response to rotation of said unit about said axis;

a pair of spaced frame members carried by and rotatable with said unit, one end of said shaft acting as a universal joint and being connected to one of said frame members, and an opposite end of said shaft being releasably connected to the other of said frame members;

said shaft being radially expandable and contractible and having fabric engaging comb means that at times extend from, and that at other times are retracted within, said shaft;

switch means associated with said fabric winding and discharging unit for stopping rotation of said unit at a fabric discharge position;

a shaft retaining/releasing device for at times securing an end of said shaft to said frame members, and for at other times moving said end of said shaft from said frame member;

a fabric receiving table carried by and rotatable with said unit, said table receiving rolls of said fabric following discharge thereof from said shaft retaining/releasing device; and a thrusting device adjacent said fabric receiving table for pushing said rolls of fabric from said fabric receiving table and said knitting machine.

2. A unit as in claim 1, wherein said fabric receiving table has a recess therein for receiving said rolls of fabric, said recess extending approximately perpendicularly to the path of travel of said rolls of fabric during discharge thereof onto said table.

3. A unit as in claim 1, wherein said shaft retaining/releasing device includes an L-shaped support member and a latch member associated therewith so as to prevent said shaft from sliding off of said support member as said shaft is moved toward said frame members.

4. A unit as in claim 2, wherein said shaft retaining/releasing device includes an L-shaped support member and a latch member associated therewith so as to prevent said shaft from sliding off of said support member as said shaft is moved toward said frame members.

5. A unit as in any of claims 1–4, wherein said thrusting device withdraws each of said rolls of fabric from said shaft, and thereafter pushes the rolls of fabric outside of said knitting machine.

6. A unit as in any of claims 1–4, and further including an electrical power supply device at the center of rotation of said unit.

7. A unit as set forth in any of claims 1–4, wherein one of said frame members has a generally C-shaped opening adjacent the lower end thereof, said opening providing access of said thrusting device to said rolls of fabric.

8. A unit as in any of claims 1–4, wherein said shaft of said fabric winding unit is spaced from the central axis of said knitting machine.

9. A unit as in any of claims 1–4, and further including switch means for, prior to halting rotation of said winding unit at said fabric discharge position, driving said knitting machine at a low speed in response to signals received from sensors upon said machine; and third switch means for confirming that said winding unit has stopped at said fabric discharge position.

10. A unit as set forth in any of claims 1–4, and further including switch means upon said fabric receiving table for detecting winding of fabric upon said shaft of said winding unit.

11. A unit as in any of claims 1–4, and further including detecting switch means for detecting whether said shaft is mounted upon said frame members of said winding unit.

12. A unit as in any of claims 3 or 4, and further including detecting switches for detecting whether said latch member is latched or unlatched.

13. A method of effecting winding and discharge of fabric knitted by a circular knitting machine having a rotatable fabric winding and discharging unit including a fabric winding shaft having extendible and retractable comb means, fabric cutting means, fabric guiding means, a gate through which rolls of fabric are discharged, latch means for releasably securing the shaft to the unit, a fabric receiving table, and a thrusting device for discharging a roll of fabric from the shaft onto a fabric receiving table; comprising the steps of:

guiding the fabric after knitting thereof to the fabric winding shaft by the fabric guiding means;

extending the comb means from the shaft so as to catch the fabric and thereby cause it to adhere to the shaft;

rolling the fabric upon the shaft;

detecting when a preselected quantity of the knitted fabric has been wound upon the shaft and then halting rotation of the winding unit at a preselected position;

cutting the fabric with the cutting means;

opening and closing the gate before and after each roll of fabric is discharged from the machine, respectively;

unlatching and latching the shaft of the winding unit shaft before and after each roll of fabric is discharged, respectively;

lowering a free end of the shaft to an elevation below that of the opposite end of the shaft to facilitate removal of each roll of the fabric from the shaft;

returning the free end of the shaft, after removal of each roll of fabric from it, to its initial position;

allowing each roll of fabric to fall from the shaft of the unit to the fabric receiving table during removal thereof from the winding unit;

pushing each roll of fabric from the fabric receiving table by the thrusting device, to discharge the roll of fabric from the knitting machine.

14. A method as in claim 13, and further including driving the knitting machine at a medium speed when the revolution of the machine reaches a value one less than a preselected value; and driving the knitting machine at a low speed when the revolution reach a second preselected value.

15. A method in claim 13 or 14, including driving the knitting machine at a low speed until winding of the fabric upon the shaft has commenced.

16. A method as in claim 13, wherein the thrusting device pushes, withdraws, and then again pushes each roll of fabric during discharge thereof from the machine.

17. A method as in claim 13, and further including supplying electric current to current consumers upon said unit, from a stationary electric current source at the center of rotation of the unit.

18. A method as in claim 13, and further including monitoring and confirming operation of the unit.

19. A method as in claim 13, and further including monitoring operation of the fabric cutting means by monitoring the current used by motors associated therewith.

20. A fabric winding and discharging unit for a circular knitting machine having a knitting section including a rotatable needle cylinder, comprising:

support means adjacent the bottom of said knitting machine mounting said unit in vertically spaced relationship to said knitting section for rotative movement about a vertical axis;

drive means for rotating said unit about said axis;

a plurality of rotatable fabric delivery rolls and a rotatable fabric winding shaft carried by and rotatable with said unit;

transmission means carried by said unit and driven by rotation of said unit about said vertical axis for imparting rotary movement to said delivery rolls and to said fabric winding shaft about the respective central axes thereof;

first and second shaft support members respectively adjacent a first, free end of said fabric winding shaft, and a second end of said shaft functioning as a universal joint;

means carried by said unit for at desired times moving said free end of said shaft downwardly to a location beneath said second end of said shaft, said means including a motor carried by said unit;

a fabric guide carried by said unit for guiding fabric onto said fabric winding shaft;

a fabric cutter carried by said unit for cutting the fabric preparatory to removal of each roll thereof from said unit, said fabric cutter including a cutter blade driven by a first motor, and a second motor for imparting translatory movement to said first motor and to said blade;

a fabric receiving table carried by and rotatable with said unit;

and fabric discharge means carried by and rotatable with said unit for discharging each roll of fabric from said unit onto said table, and for thereafter discharging each roll of fabric from said machine, said fabric discharge means including a thruster device and a motor for driving said thruster device;

a movable gate, said rolls of fabric being discharged from said knitting machine through said gate when said gate is in an open position; and a drive motor for moving said gate between open and closed positions;

and an electric current generator driven in response to rotation of said unit and located at the center of rotation thereof for supplying electricity to said motors upon said unit.

* * * * *

UNITED STATES PATENT AND TRADEMARK OFFICE

CERTIFICATE OF CORRECTION

PATENT NO. : 5,285,663

DATED : February 15, 1994

INVENTOR(S) : Kozo Taniguchi

It is certified that error appears in the above-identified patent and that said Letters Patent is hereby corrected as shown below:

Column 2, line 42, before "shaped" insert -- L --.

Column 5, line 52, "23" should be -- 3 --.

Column 5, line 68, "by.," should be -- by, --.

Column 6, line 5, the number "0" should be the letter -- O --.

Column 7, line 18 "s" should be -- 8 --.

Column 7, line 26, after "and" insert -- 20) --.

Column 7, line 39, before "cutter" insert -- movable --.

Column 8, line 18, after "28" delete -- , --.

Column 8, line 34, "a" (first occurrence) should be -- an --.

Column 8, line 41, "Cutaway" should be -- cutaway --.

Column 8, line 60, "dinq" should be -- ding --.

Column 8, line 68, "pusher" should be -- Pusher --.

Column 9, line 6, "Channel" should be -- channel --.

Column 9, line 56, "s" should be -- 8 --.

UNITED STATES PATENT AND TRADEMARK OFFICE

CERTIFICATE OF CORRECTION

PATENT NO. : 5,285,663

DATED : February 15, 1994

INVENTOR(S) : Kozo Taniguchi

It is certified that error appears in the above-identified patent and that said Letters Patent is hereby corrected as shown below:

Column 9, line 62, "s" should be -- 8 --.

Column 10, line 14, "S10" should be -- KS10 --.

Column 11, line 11, "Whether" should be -- whether --.

Column 14, line 48, after "and" begin a new paragraph with the word "third".

Signed and Sealed this

Nineteenth Day of July, 1994

Bruce Lehman

*Attest:*

BRUCE LEHMAN

*Attesting Officer*

*Commissioner of Patents and Trademarks*